US008307685B2

(12) United States Patent
Heinz et al.

(10) Patent No.: US 8,307,685 B2
(45) Date of Patent: Nov. 13, 2012

(54) MULTI-DIRECTIONALLY SWEPT BEAM, ROLL FORMER, AND METHOD

(75) Inventors: Richard D. Heinz, Grand Haven, MI (US); Bruce W. Lyons, Grand Haven, MI (US); Bryan E. Gould, Coopersville, MI (US)

(73) Assignee: Shape Corp., Grand Haven, MI (US)

( * ) Notice: Subject to any disclaimer, the term of this patent is extended or adjusted under 35 U.S.C. 154(b) by 776 days.

(21) Appl. No.: 12/419,626

(22) Filed: Apr. 7, 2009

(65) Prior Publication Data

US 2009/0255310 A1 Oct. 15, 2009

Related U.S. Application Data

(60) Provisional application No. 61/043,541, filed on Apr. 9, 2008.

(51) Int. Cl.
*B21B 15/00* (2006.01)

(52) U.S. Cl. ..... 72/177; 72/168

(58) Field of Classification Search ..... 72/166, 72/168, 172, 173, 174, 175, 177, 181, 169, 72/182, 369
See application file for complete search history.

(56) References Cited

U.S. PATENT DOCUMENTS

| | | | | |
|---|---|---|---|---|
| 1,857,325 | A | 5/1932 | Ottenstein | |
| 2,279,197 | A | 4/1942 | Hoell | |
| 2,880,013 | A | 3/1959 | Dean | |
| 2,971,556 | A * | 2/1961 | Armstrong et al. | 72/42 |
| 3,258,956 | A * | 7/1966 | Landwehr et al. | 72/466 |
| 3,452,568 | A | 7/1969 | Vihl | |
| 3,845,648 | A | 11/1974 | Shubin et al. | |
| 3,912,295 | A | 10/1975 | Eggert, Jr. | |
| 3,986,381 | A | 10/1976 | Shubin et al. | |
| 4,117,702 | A | 10/1978 | Foster | |
| 4,391,116 | A | 7/1983 | Yogo | |
| 4,627,254 | A | 12/1986 | Kitsukawa et al. | |
| 4,910,984 | A | 3/1990 | Young et al. | |
| 5,092,512 | A * | 3/1992 | Sturrus et al. | 228/146 |
| 5,104,026 | A * | 4/1992 | Sturrus et al. | 228/17.5 |
| 5,239,850 | A | 8/1993 | Shimokata | |
| 5,425,257 | A | 6/1995 | Kitsukawa et al. | |
| 5,454,504 | A * | 10/1995 | Sturrus | 228/17 |
| 5,561,902 | A | 10/1996 | Jacobs | |
| 6,026,573 | A | 2/2000 | Macchione | |

(Continued)

FOREIGN PATENT DOCUMENTS

JP 61132226 A 6/1986

(Continued)

*Primary Examiner* — Edward Tolan
*Assistant Examiner* — Lawrence J Averick
(74) *Attorney, Agent, or Firm* — Price Heneveld LLP

(57) ABSTRACT

A high-strength beam includes first and second sections bent in opposite directions as part of a roll-forming process. A frame includes side frame members incorporating the double-bent beam and at least one energy management tube attached to the beam. In one form, the beam is tubular and has a cross-sectional dimension of greater than 25 mm and a material strength of at least about 60 KSI tensile strength. A roll form apparatus includes a roll former device and a sweep station in-line with the roll former device for sweeping the continuous beam in first and second opposing directions. Also, a method of roll-forming comprises steps of: roll-forming a sheet of material into a continuous beam and sweeping first and second sections of the beam in opposite directions.

22 Claims, 24 Drawing Sheets

U.S. PATENT DOCUMENTS

| | | | | |
|---|---|---|---|---|
| 6,183,013 | B1 | 2/2001 | Mackenzie et al. | |
| 6,189,354 | B1 | 2/2001 | Spath | |
| 6,253,591 | B1 | 7/2001 | Sayama et al. | |
| 6,484,386 | B2 * | 11/2002 | Tuin et al. | 29/564.8 |
| 6,598,447 | B2 | 7/2003 | Meliga | |
| 6,662,613 | B2 | 12/2003 | Ichiryu et al. | |
| 6,709,036 | B1 | 3/2004 | Evans | |
| 6,725,700 | B2 | 4/2004 | Yogo | |
| 6,820,451 | B2 * | 11/2004 | Renzzulla et al. | 72/173 |
| 6,910,721 | B2 * | 6/2005 | Bladow et al. | 293/102 |
| 7,066,525 | B2 * | 6/2006 | Jaeger et al. | 296/102 |
| 7,197,824 | B1 * | 4/2007 | Graber | 29/897.2 |
| 7,360,386 | B2 * | 4/2008 | Bair | 72/168 |
| 2004/0154158 | A1 * | 8/2004 | Sundgren et al. | 29/564 |
| 2005/0062299 | A1 | 3/2005 | Renzzulla et al. | |
| 2005/0138812 | A1 * | 6/2005 | Bladow et al. | 29/897.2 |
| 2005/0162631 | A1 * | 7/2005 | Graber | 355/67 |
| 2006/0016078 | A1 | 1/2006 | Bladow et al. | |
| 2006/0277960 | A1 | 12/2006 | Lyons et al. | |
| 2007/0074556 | A1 * | 4/2007 | Heatherington | 72/177 |
| 2007/0095001 | A1 * | 5/2007 | Heatherington | 52/729.1 |
| 2007/0180880 | A1 | 8/2007 | Lyons et al. | |

FOREIGN PATENT DOCUMENTS

| | | | |
|---|---|---|---|
| JP | 02037919 | A | 2/1990 |
| JP | 09225540 | A | 9/1997 |

* cited by examiner

MULTI-DIRECTIONALLY SWEPT BEAM, ROLL FORMER, AND METHOD

This application claims benefit under 35 U.S.C. §119(e) of provisional application Ser. No. 61/043,541, filed Apr. 9, 2008, entitled MULTI-DIRECTIONALLY SWEPT BEAM, ROLL FORMER, AND METHOD, the entire contents of which are incorporated herein in their entirety.

BACKGROUND

The present invention relates to multi-directionally swept beams and also roll-forming apparatus and methods for forming multi-directionally swept beams and structural members, such as can be used as bumper reinforcement beams, vehicle frames, and non-linear structural members. The present invention further relates to beams and structural members made by same. The present invention is not limited to only bumper reinforcement beams and/or vehicle frames, nor is it limited to apparatus and methods for forming/constructing only these components.

Roll-forming can be a particularly cost-effective way of producing elongated beams and structural members (channel-shaped and tubular), since roll-forming is capable of mass-producing high volumes with relatively lower cost tooling and longer lasting tooling (as compared to stamping dies, especially when high-strength materials are being formed that will quickly wear out stamping dies). However, roll-forming has limitations, such as a limited ability to form non-linear products.

Several ways are known for forming sweeps and curved elongated structural members. For example, see Sturrus U.S. Pat. No. 5,092,512, Sturrus U.S. Pat. No. 5,454,504, and Lyons Published Application U.S. 2006/0277960 which disclose ways of imparting a sweep(s) into a continuous beam made of high-strength material, where the beam has a strength and shape suitable for use as a bumper reinforcement beam. However, these processes are limited to forming beams swept to form one-directional concave shapes. These processes are not capable of forming a beam with alternating (back-and-forth) sweeps, where the alternative sweeps are in opposite directions away from a roll-formed centerline.

Notably, the difficulties of consistently sweep-forming beams and structural members into non-linear shapes is greatly increased as the size and bending moment of a structural beam increases, such as when the beam has a tubular cross section of greater than 50 mm×50 mm, and/or when the sheet material has a high strength (e.g., greater than about 60 KSI tensile strength up to 220 KSI tensile strength), and/or when the swept curvature is relatively sharp such as defining a radius of less than 1500 mm, and/or when sheet thicknesses are greater than 2 mm, . . . especially for combinations of the above.

SUMMARY OF THE PRESENT INVENTION

In one aspect of the present invention, a roll form apparatus includes a roll former with rolls for forming a sheet of steel material into a structural beam defining a longitudinal line. The apparatus further includes a sweep station in-line with the roll former, where the sweep station includes a sweep-forming device for selectively sweeping the structural beam in a first direction away from the longitudinal line and in a second direction opposite the first direction away from the longitudinal line while continuously operating the roll former.

In another aspect of the present invention, a sweep station is provided for sweeping sections of a beam away from a longitudinal line defined by the beam. The sweep station includes a main frame, and a sweep-forming device including a subframe operably supported on the main frame for movement to a first position to sweep a first section of the beam in a first direction away from the longitudinal line and for movement to a second position to sweep a second section of the beam in a second direction away from the longitudinal line, the second direction being on a side opposite the first direction.

In another aspect of the present invention, a method of roll-forming comprises steps of: roll-forming a sheet of material into a continuous beam defining a longitudinal line; and during the step of roll-forming, sweeping a first section of the continuous beam in a first direction away from the longitudinal line and sweeping a second section of the continuous beam away from the longitudinal line in a second direction different than the first direction.

In a narrower aspect of the present invention, the method includes forming a frame incorporating the beam with first and second oppositely swept sections.

In a narrower aspect of the present invention, the beam forms a bumper reinforcement beam and/or a vehicle frame component.

In a narrower aspect of the present invention, an energy-absorbing bumper-mounting bracket is attached to the beam at an end of the beam.

In a narrower aspect of the present invention, the beam is tubular and has a cross-sectional dimension in a direction of the bend that is at least about 25 mm. Further, the material strength is preferably at least about 60 KSI tensile strength, for providing a high strength-to-weight ratio.

An object of the present invention is to provide a beam, either channel-shaped or tubular, made from steel sheet material (or having similar or greater tensile strength) and with a cross section of substantial size (such as 2 inches or more in a direction of bending), where the beam is swept back-and-forth in opposite directions from a roll-formed centerline during the roll forming process.

An object of the present invention is to provide an apparatus and method capable of sweeping a beam of substantial material strength and cross-sectional beam strength in a back-and-forth pattern including swept sections curved in opposite directions from a roll-formed centerline.

An object of the present invention is to construct a frame using the beam components with back-and-forth sweeps as noted above.

An object of the present invention is to provide internal and/or external stabilizers in a roll-forming apparatus to allow the apparatus to make increasingly sharp sweeps in a beam while maintaining dimensional accuracy and consistency of the beam's cross section.

These and other aspects, objects, and features of the present invention will be understood and appreciated by those skilled in the art upon studying the following specification, claims, and appended drawings.

DETAILED DESCRIPTION OF PREFERRED EMBODIMENTS

Figure 1:
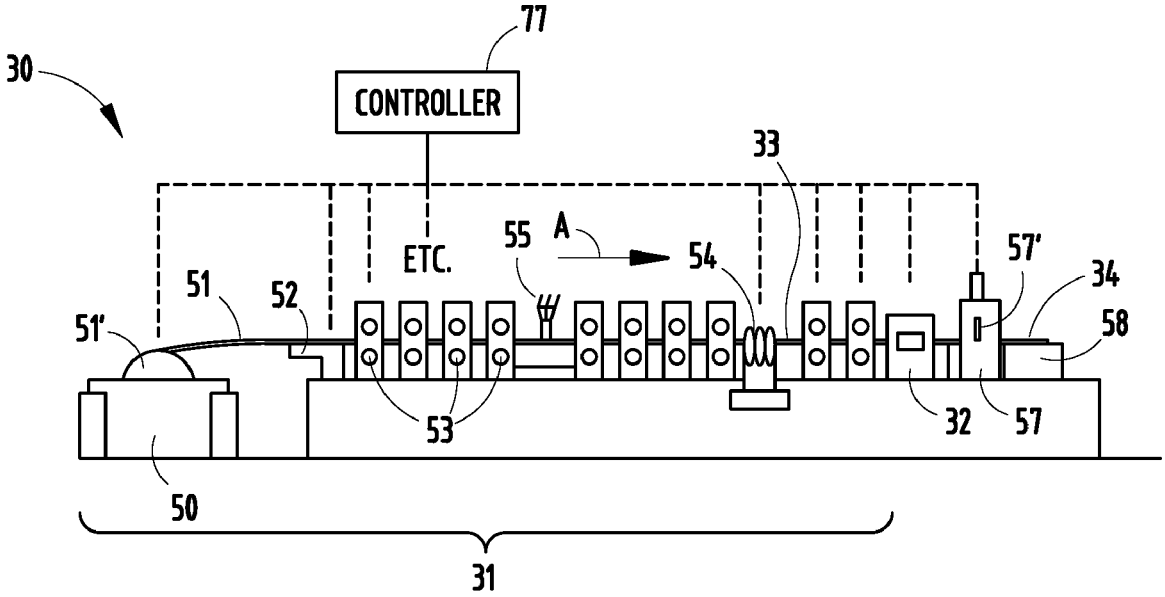
FIG. 1 is a side view of a roll-forming apparatus including a bidirectional sweep station of the present invention.

A roll form apparatus 30 (FIG. 1) is provided that includes a roll former 31 (also called a "roll-forming device") for forming a continuous beam 33 along line direction "A", and a sweep station 32 in-line with the roll former device 31 for sweeping (i.e., longitudinally curving) the continuous beam 33 in first and second opposing directions from a centerline of the continuous beam (also called "bidirectional bend" or "bilateral sweep" herein) "on the fly" during continuous operation of the roll former device 31. Also, a related method of roll-forming is disclosed comprising steps of roll-forming a sheet of material into a continuous beam and sweeping first and second sections of the beam in opposite directions from the centerline. Notably, roll form apparatus can form the beam to include any number of different swept sections, depending on the functional requirements of the application where the structural beam will be used, as discussed below. The roll form apparatus including the sweep station is robust and hence is capable of forming a variety of metal materials having different strengths (such as 40 KSI tensile strength or less . . . up to 220 KSI tensile strength materials or more) and many different sizes including large cross-sectional beam sections (such as 40 mm×150 mm, or 40 mm×40 mm, or 80 mm×120 mm) and many different shapes of cross sections (such as "B," "D," "C" or other cross-sectional shapes). The illustrated continuous beam 33 is cut into beam segments 34 (also called "reinforcement beams" or "structural beams" or "bumper beams") having a length and shape suitable for use as bumper reinforcement beams.

Figure 11:
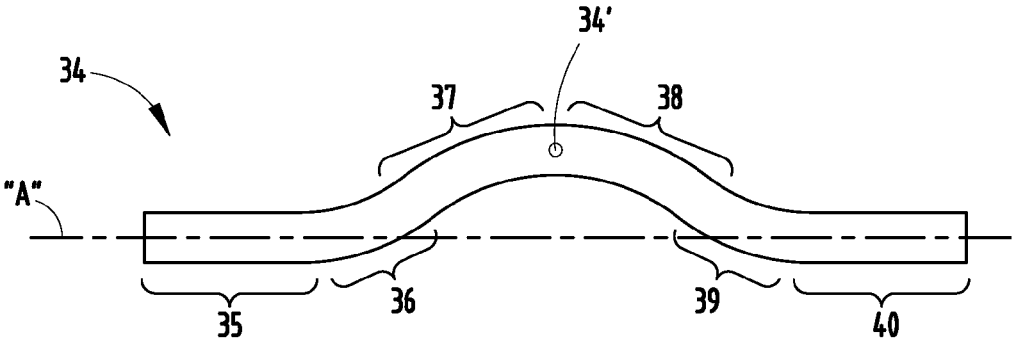
FIG. 11 is a top view of a bumper reinforcement beam (also called "beam segment") formed in two directions by the apparatus of FIG. 1 such that end sections of the beam are collinear but a center section is offset.

An exemplary bumper reinforcement beam 34 (FIG. 11) is made of high-strength material such as 60 KSI tensile strength steel with wall thickness of about 2 mm sheet thickness, and has a cross-sectional tubular shape with depth of 80 mm and similar height (in a vehicle-mounted position). The beam 34 can be used as a bumper reinforcement beam, and can include a hole 34' such as for supporting a trailer hitch/ball. The illustrated beam has a cross section defining a single tube, but it is contemplated that a beam can define multiple tubes (e.g., B-shaped) or an open channel (e.g., C-shaped). The illustrated beam 34 is formed on the roll form apparatus 30 to include multiple sections 35-40, with sections 36/37 bent in the sweep station in opposite directions and sections 38/39 bent in opposite directions as part of the sweeping process simultaneous with and during the roll-forming process. As illustrated, the beam 34 can be used as a bumper reinforcement beam, with ends 35 and 40 including welded-on mounting brackets (not specifically shown) that are configured for attachment to a vehicle. Many bumper mounting brackets are known in the art, such that a detailed discussion of them is not required.

Notably, the center section 37/38, defines a single plane with ends 35 and 40, but the center section 37/38 is bent to a misaligned position relative to the ends 35 and 40 as part of the roll-forming and sweeping operation. The center section 37/38 can additionally be reformed in a secondary operation to position the center section 37/38 rearward as well as below the aligned ends 35 and 40 (with top and bottom surfaces maintained in a horizontal orientation, when in the vehicle-mounted position.) This allows use of a single cross beam (34) to support a hitch (and trailer tongue) (see hole 34' for receiving a ball hitch), yet allows proper height and fore-aft position of the hitch relative to the vehicle frame. Further, it allows all of the orthogonal walls of the beam (34) to be optimally oriented in horizontal and vertical positions for supporting weight.

Figure 12:
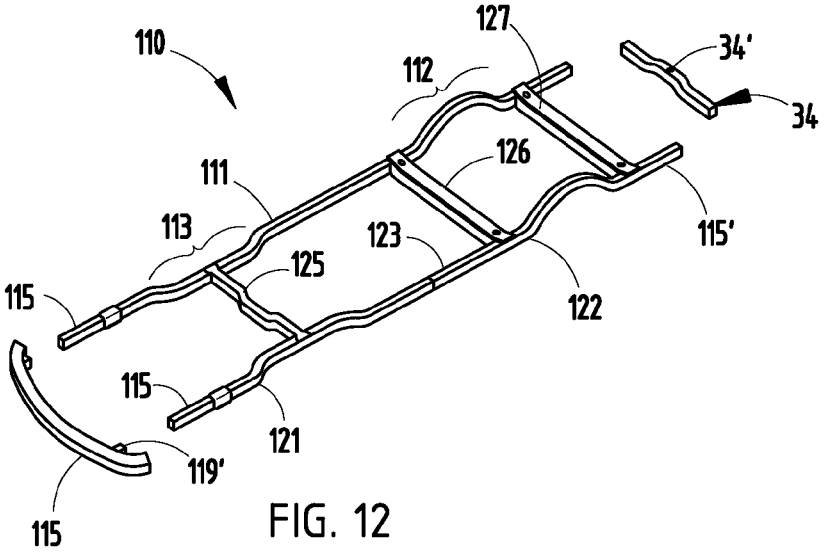
FIG. 12 is a perspective view of a vehicle frame incorporating bi-directionally bent beam components that are welded together along with mounting brackets (such as for mounting bumper reinforcement beams) to form a complete vehicle frame.

A variety of different frame and structural components can be made using the concepts incorporated into the shape of the beam 34. For example, FIG. 12 illustrates a vehicle frame, where the components 111, 121, 125-127 are welded (or bolted) together to form a basic passenger vehicle frame (see FIG. 12), including features for clearing wheels of the vehicle and for providing optimal non-linear support for its motor and vehicle suspension components. Notably, the bilaterally swept beam sections made by the present roll form apparatus 30 can be used to form side frame members and cross beam members. Each of the illustrated beams incorporate strategically-located bends, at least two of the bends being formed in opposite directions from a centerline of the continuous beam. It is contemplated that a large number of additional structural frame members and components can be made, including frames for sport vehicles such as snowmobiles and all terrain vehicles; frames for other vehicles such as farm equipment, trucks, trains, and any land, water, air, and/or snow vehicles; other structural members for vehicles such as roof bows, door beams, and the like; structural members for furniture, such as for partition panels, desks, office systems, and the like; and a variety of other structural members that are elongated and require bidirectional bending in at least two places.

More specifically in regard to the roll form apparatus 30 (FIG. 1), an uncoiler 50 feeds sheet material 51 from a coil 51' to a straightener 52 (and/or pre-pierce die) and into the roll former device 31. Rolls 53 form the sheet material 51 into a desired cross-sectional shape, such as into a continuous beam 33 defining a D-shaped single tube. A welder 54 (optional, used to permanently fix the tube in a closed tubular section) welds the sheet material into the shape of a permanent tube. An upstream anchor 55 (optional, used if internal mandrels are necessary to maintain a shape of a tubular beam during sweeping) supports a downstream anchor line for securing an internal mandrel(s) in a fixed downstream position (see FIG. 14-19).

The sweep station 32 is attached in-line at an end of the roll former 31, and includes sweeping rolls for selectively sweeping/deforming the continuous beam 33 in either of opposing directions from the longitudinal centerline of the continuous beam 33. A cutoff device 57 receives the bilaterally swept beam 33 and cuts it at selected locations relative to the bends formed in the bilaterally swept beam 33 to achieve beam segments 34 having a desired length, and with the swept sections contained at strategic locations along the beam segments 34. The illustrated bilaterally swept beam segment 34 includes sections 35-40 (FIG. 11) all lying in a common plane and with sections 36-39 being deformed (into the paper and out of the paper as illustrated in FIG. 1), such that the bumper components able to lie on (and are continuously supported on) a flat-topped table support 58 as they are separated by cutoff device 57 with guillotine blade 57'.

Figure 2:
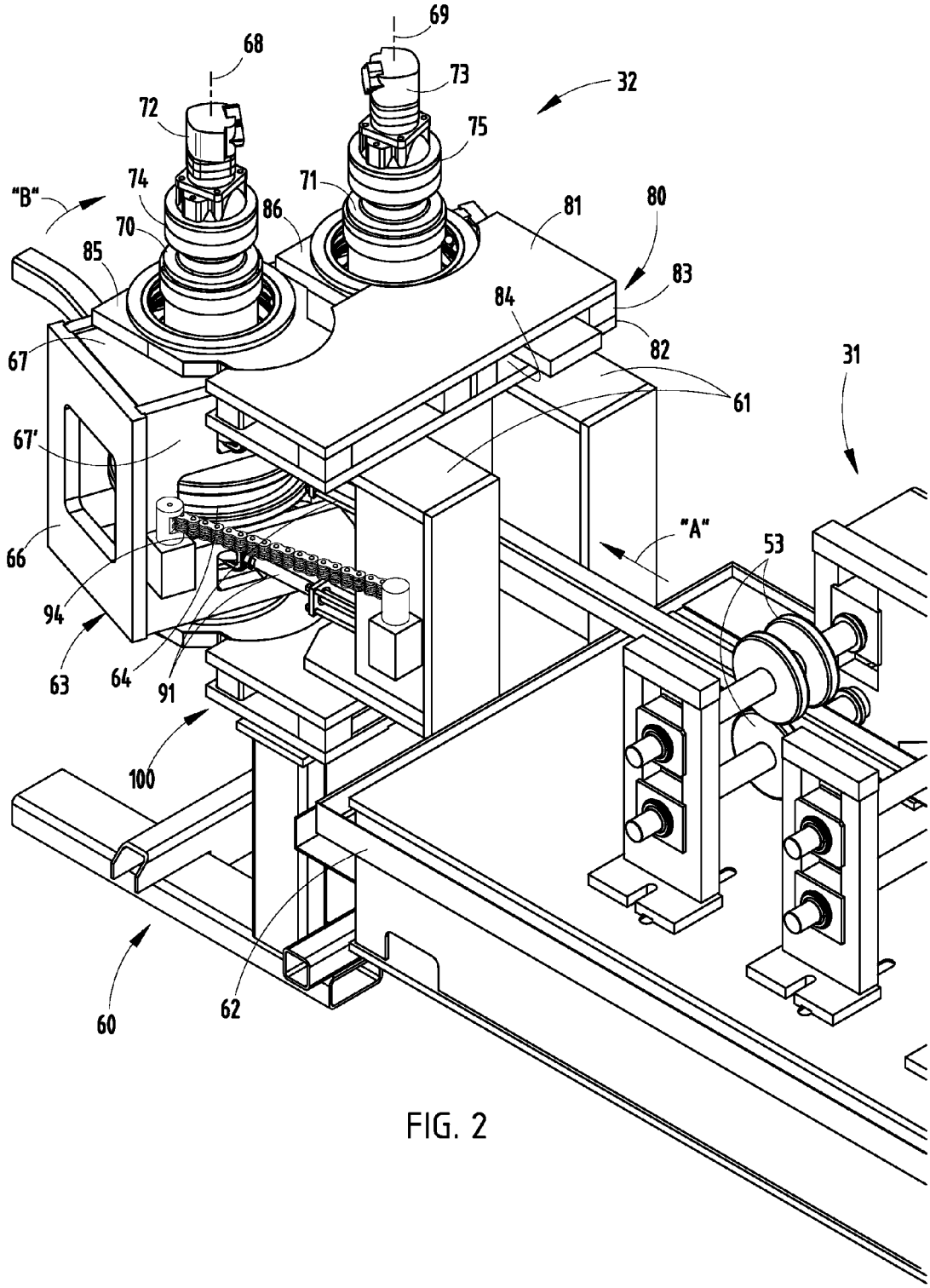
FIGS. 2-3 are perspective views of an end of the roll-forming apparatus including the bidirectional sweep station of FIG. 1, FIG. 3 including parts removed to better show components therebelow.
Figure 3:
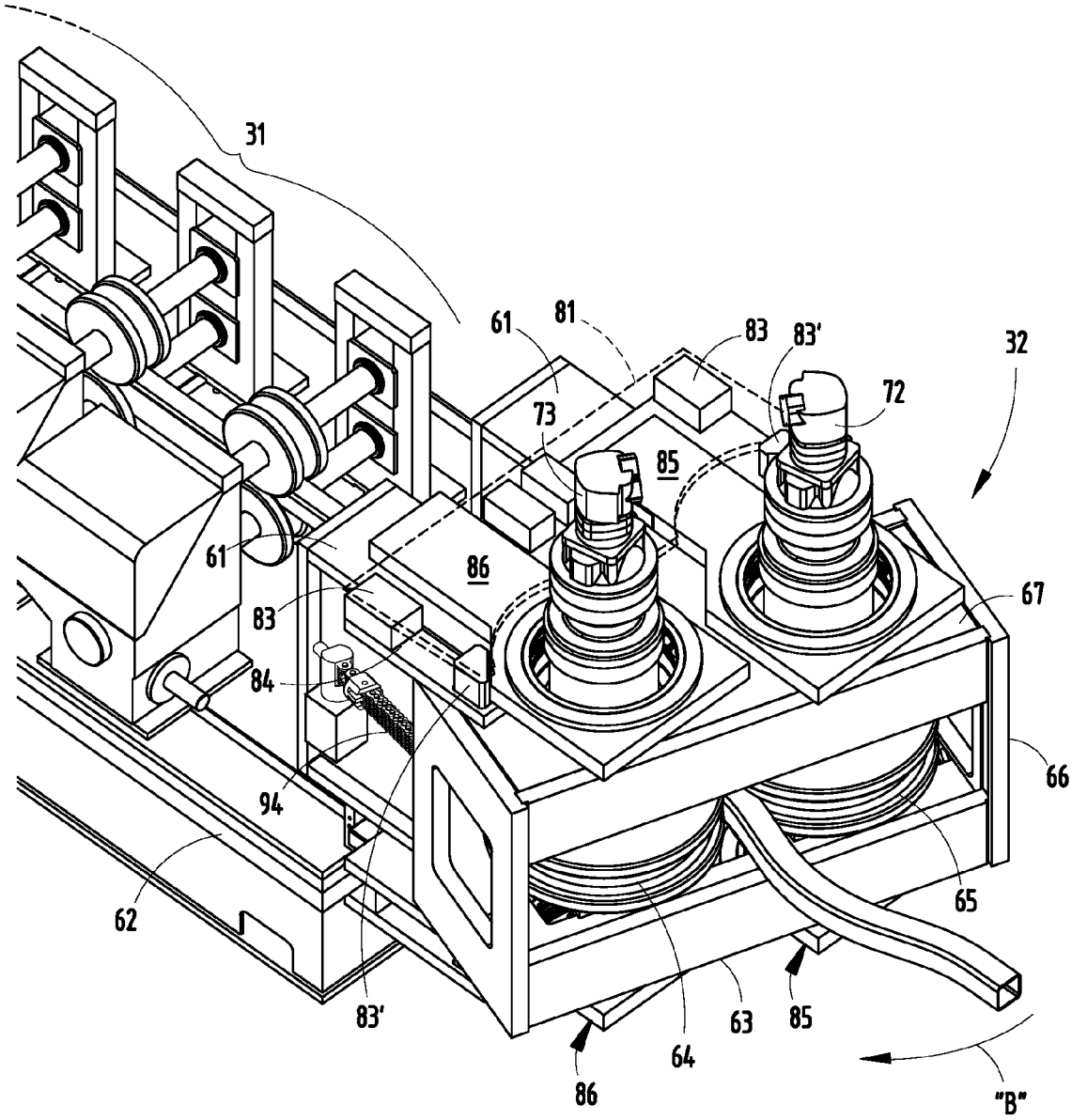

The sweep station 32 (FIG. 2) includes a support frame 60 with a pair of anchoring stanchions 61 attached to the bed 62 of the roll former 31, and further includes a box-like subframe 63 for operably movably supporting sweep bending rollers 64 and 65 for double-pivoting-and-translating movement on bearing structures 80 and 100 of the frame 60. The subframe 63 includes end plates 66 and top/bottom cross plates 67 as well as front/rear cross plates 67' assembled to form a box-like arrangement with the sweep bending rollers 64 and 65 positioned inside. Axles 68 and 69 (see center-lines identified in FIG. 2) extend through and adjustably support the sweep bending rollers 64 and 65. The axles 68 and 69 each include ends that extend through bearings 70 and 71 for adjustable support on the cross plates 67. Pumps/motors 72 and 73 are attached to the upper end of axles 68 and 69. The motors 72 and 73 are operably connected to and independently controlled by a controller 74 for variable speed. (See FIG. 4.) The casings of the motors 72 and 73 are fixed to the subframe 63 by structural housings (not specifically shown, but in the area of numbers 74 and 75).

Figure 4:
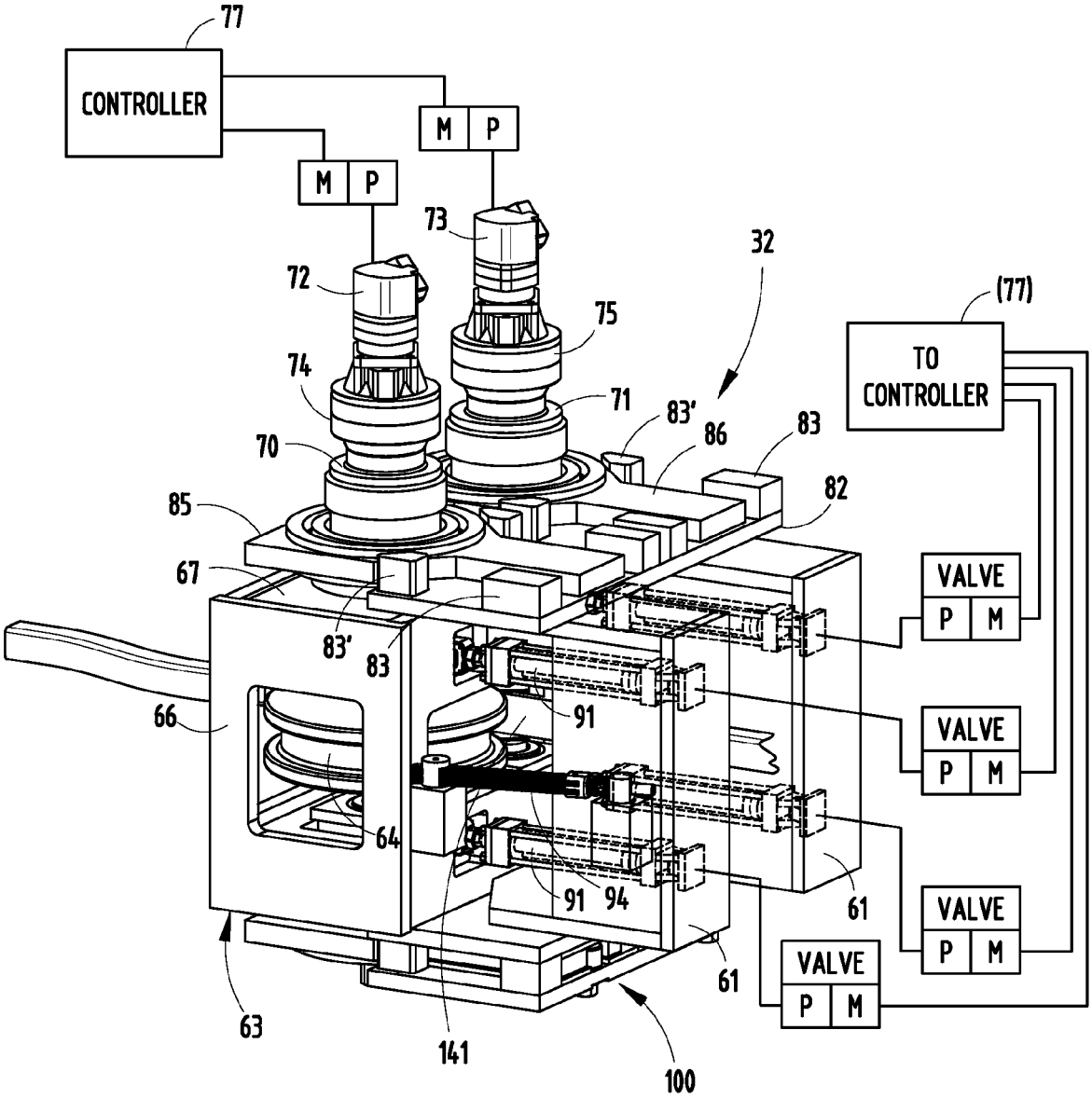
FIGS. 4-5 are perspective and top views of the sweep station of FIG. 3 in a home position where the continuous beam remains linear as it passes through the sweep station.
Figure 5:
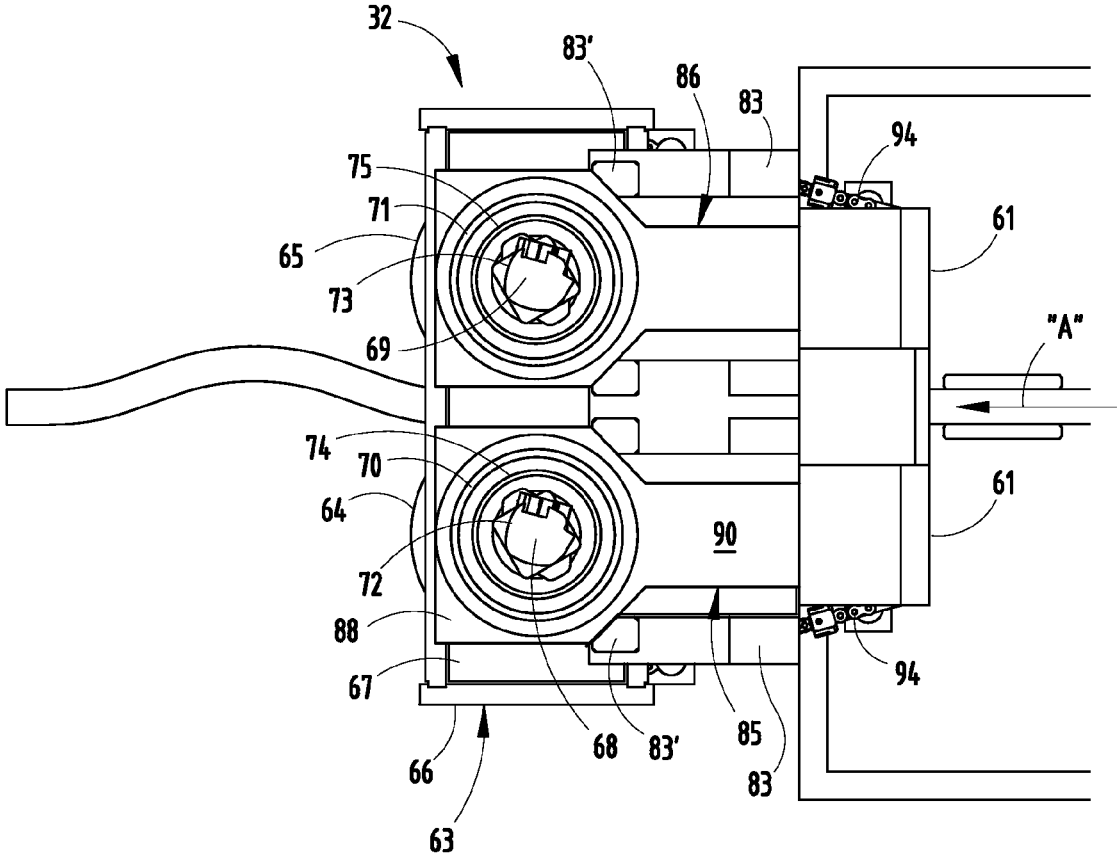
Figure 6:
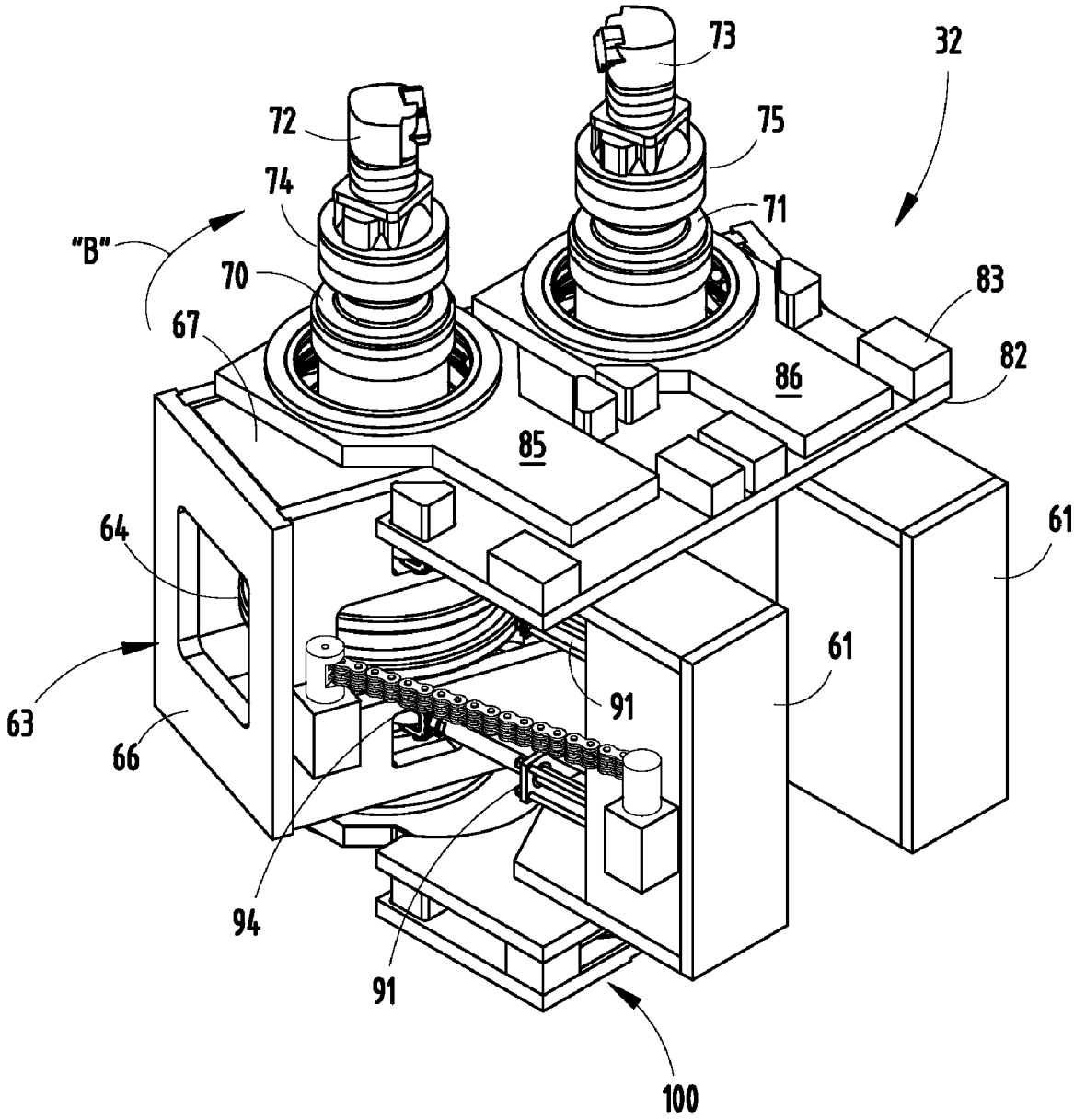
FIGS. 6-7 are perspective and top views of the sweep station of similar to FIGS. 2-3 in a first position where the continuous beam is swept in a first direction "B" away from its roll-formed centerline.
Figure 7:
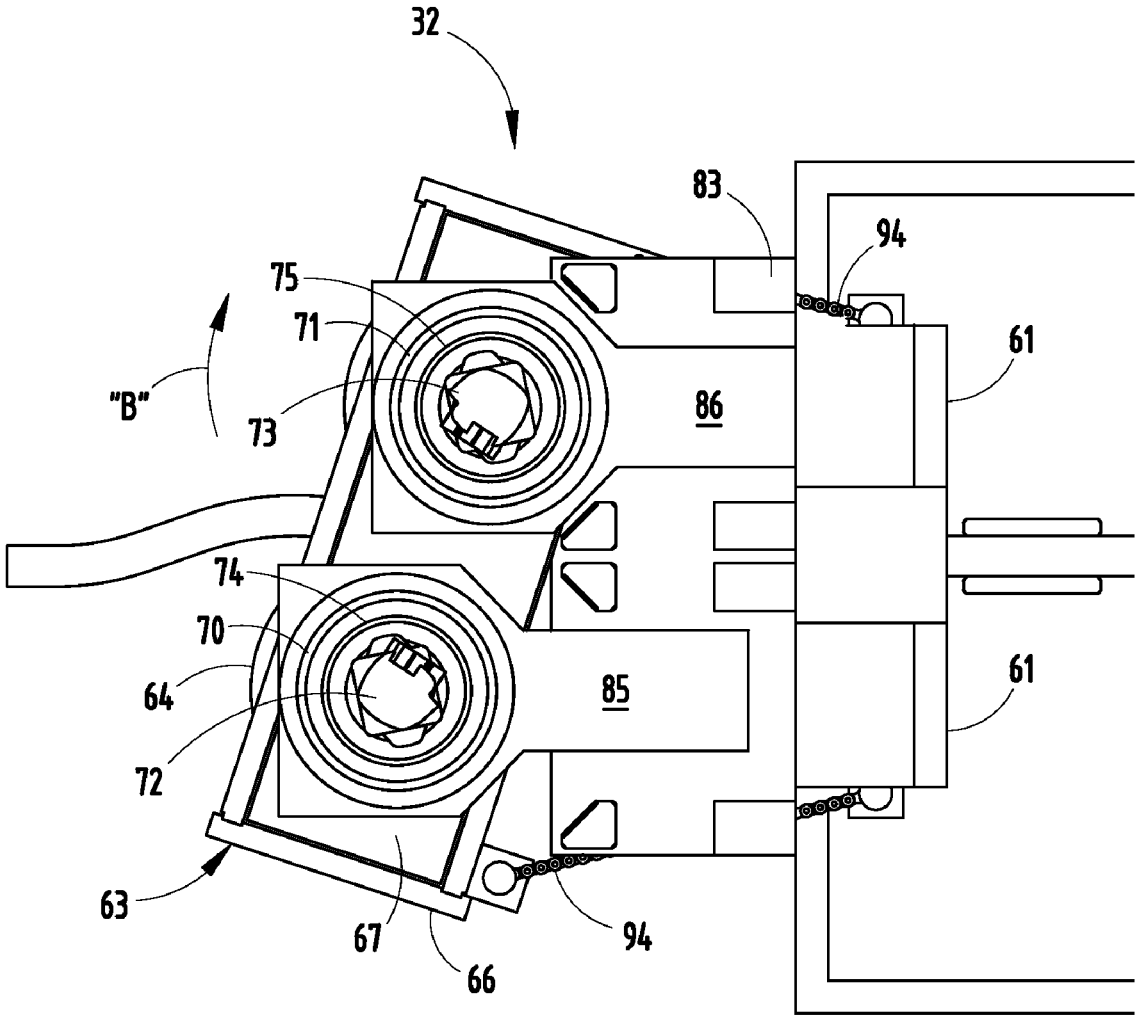
Figure 8:
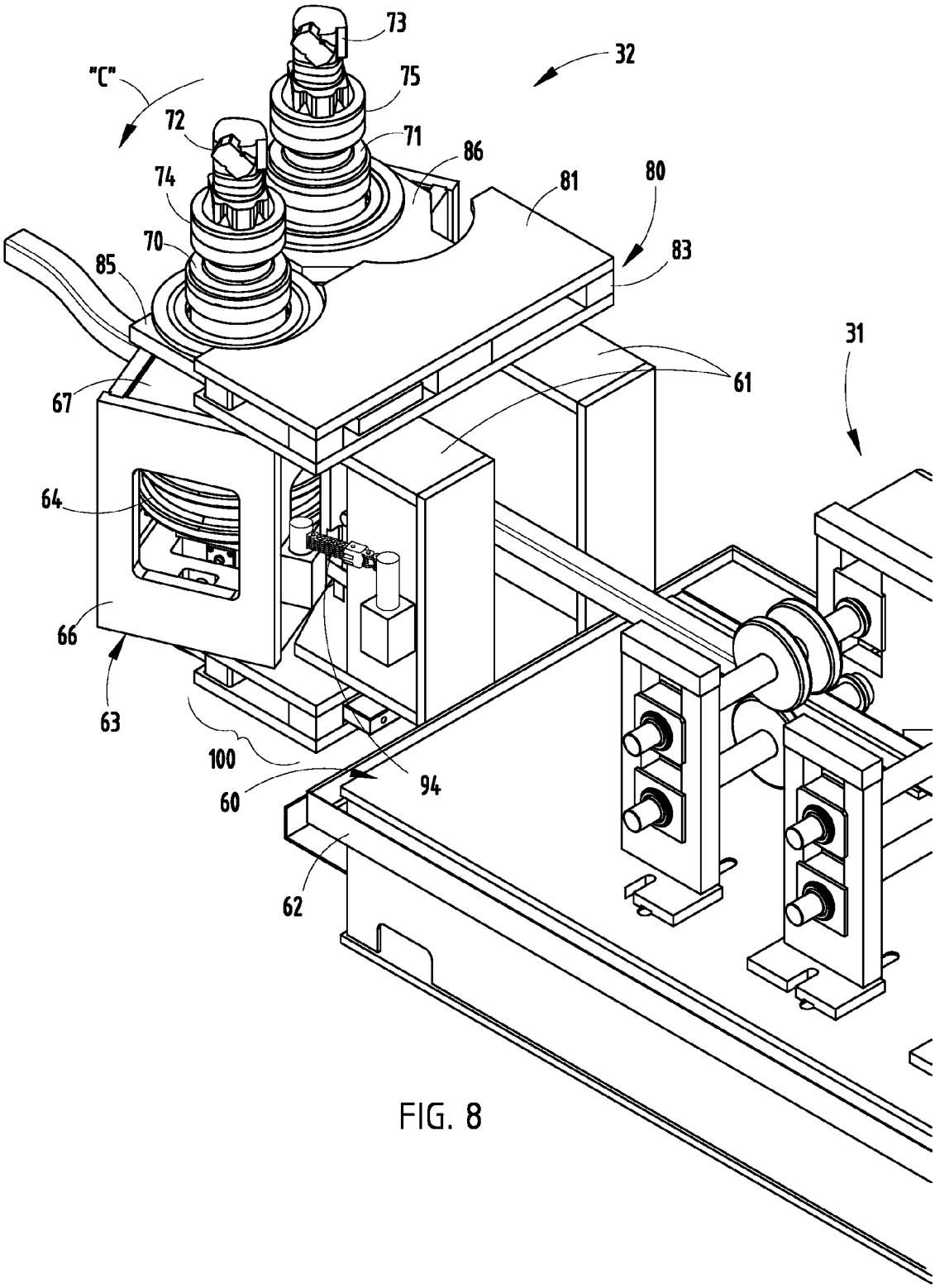
FIGS. 8-10 are two perspective views and a top view of the sweep station of FIG. 3 in a second position where the continuous beam is swept in a second direction "C" opposite the first direction and away from its roll-formed centerline.
Figure 9:
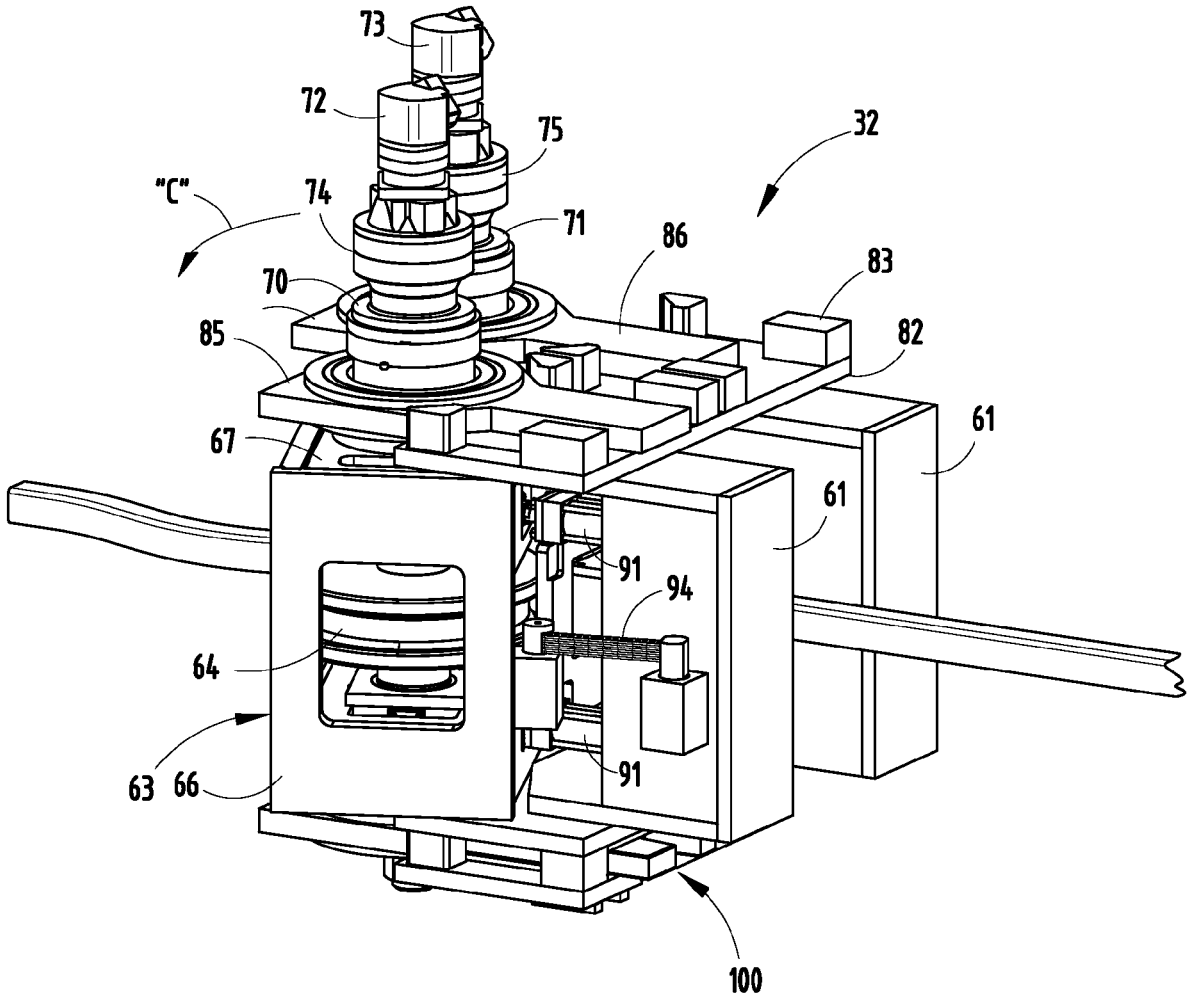
Figure 10:
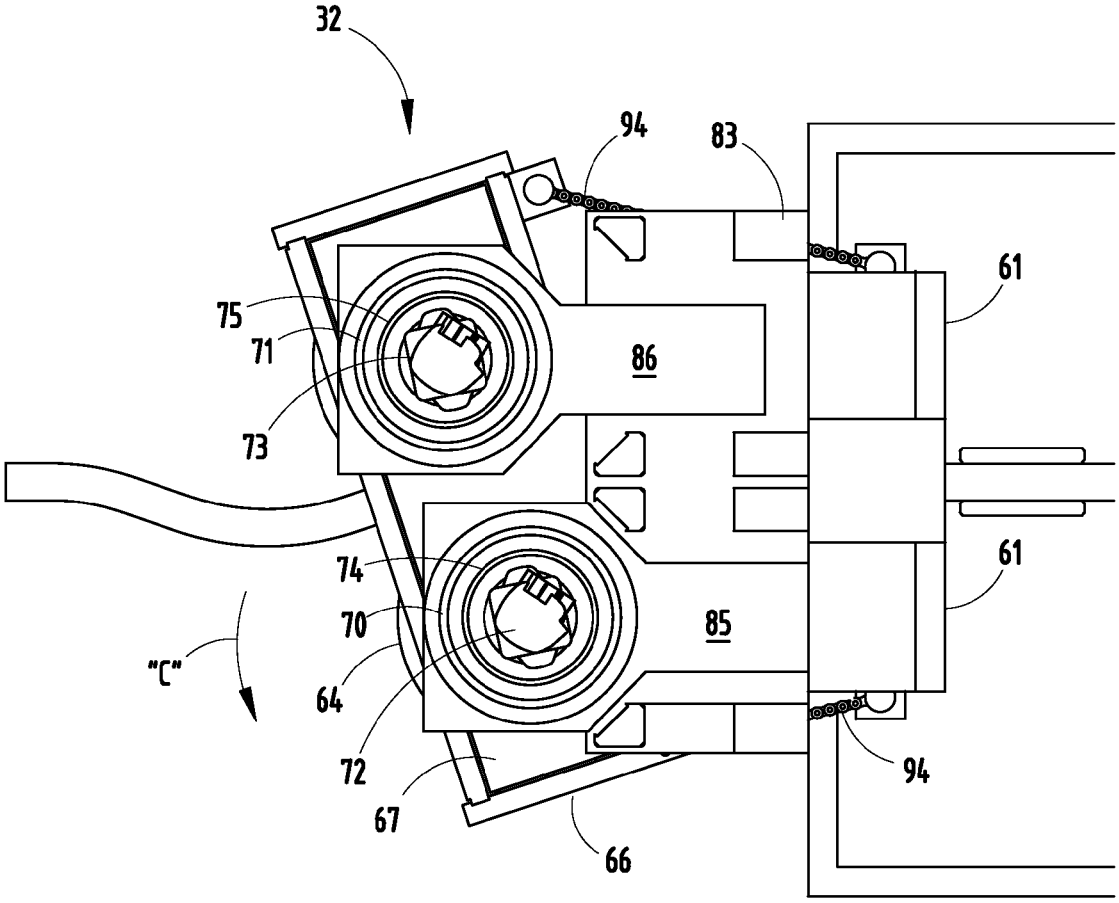

The subframe 63 is operably supported for double-pivoting-and-translating movement by adjustable support structure that engages bearing structures 80 and 100 on the frame 60 as shown by FIGS. 5, 7, and 10 (and FIGS. 2-10 generally). More specifically, the subframe 63 is supported in a home position (FIGS. 4-5, with the rollers 64 and 65 defining a line perpendicular to the longitudinal direction "A" of the beam 33 as the beam 33 is being roll-formed). As shown in FIGS. 7 and 10, the subframe 63 can be selectively rotated (in a downstream direction) about bearing in slide members 85 and 86 that support the axle 68 and axle 69.

In particular, the adjustable support structure (FIG. 2) includes top and bottom bearing structures 80 and 100 as follows. The top bearing structure 80 includes upper and lower bearing plates 81 and 82 secured together by spacers 83 to define a top gap 84. The adjustable support structure further includes first and second plate-like extendable guide-following slide members 85 and 86 at the top (and an additional two slide members 85 and 86 at the bottom) that are slidably supported in the gap 84 between the plates 81 and 82 in adjacent positions. The guide-following slide member 85 includes a large end 88 (FIG. 5) with a bearing for both supporting the subframe 63 and allowing rotation of the subframe 63 along an arcuate downstream path. The subframe 63 also includes a bearing that in turn supports the axle 68. The slide member 85 further includes a narrow end 90 that matably fits between and stably engages the spacers 83 and 83'. In an upstream home position (FIGS. 4-5), the angled surfaces between the large and narrow ends 88 and 90 abut stops 83' to cause accurate positioning of the subframe 63. The slide member 86 is similar to slide member 85 in its movement, engagement with bearing supports, and support of the subframe 63.

Two of the spacers 83' form a wedging-type stop for limiting upstream movement of the plate-like guide-following slide member 85. When both plate-like guide-following slide members 85 and 86 are in their seated upstream position (FIGS. 4-5), the subframe 63 is square to the continuous beam 33, with rollers 64 and 65 being opposite each other in a perpendicular arrangement to the continuous beam 33. When in the seated position, the sweep station 32 does not bend the continuous beam 33, such that the beam 33 remains linear.

Two pair of hydraulic actuators 91 (FIG. 4) are connected between the subframe 63 and stanchions 61, with one top and one bottom actuator on each side. The actuators 91 on each side are operably connected to a pump motor 92, which are controlled by the sweep apparatus controller . . . which is in turn controlled by a main controller 77 for operating the roll former (FIG. 1). (Notably, the controller 77 can be a single unit, or a main computer controlling various sub-control units around the apparatus 20.) A multi-link chain 94 (also called a "sweep limiter") connects the subframe 63 to the stanchions 61 for limiting a maximum angular downstream movement of the subframe 63 on the main frame 60. The chain 94 provides safety to reduce the chance of the subframe 63 moving to an extreme downstream position that could stress and damage machine components, such as if one of the actuators 91 fail or break loose.

As noted above, the adjustable support structure further includes a bottom bearing structure 100 (FIG. 2) that includes identical components and action as the top bearing structure 80, including upper and lower plate-like slide members, stops/spacers, and actuators.

As shown by FIGS. 4-5, the sweep station 32 has a home position where the continuous beam 33 is not deflected/deformed/swept. (Notably, the bent portion of the illustrated beam 33 in FIGS. 4-5 that extends downstream from the sweep station was bent/swept prior to the subframe 63 being moved back to its home position as in FIGS. 4-5.) The sweep station 32 also has a first rotated position (FIGS. 6-7) for sweepingly deforming the beam 33 in a first direction "B" away from a longitudinal centerline 95 of the beam 33, and an opposite second rotated position (FIGS. 8-10) for sweepingly deforming the beam 33 in a second direction "C" opposite the first direction away from the longitudinal centerline.

In the first position of FIG. 6, the plate-like guide-following slide member 86 is in the home position, but the plate-like guide-following slide member 85 is slid downstream and pivoted slightly so that the spacing of axles 68 and 69 is maintained (so that they continue to engage opposing sides of the continuous beam 33). As a result, the beam 33 is bent in direction "B" as it passes between rollers 64, 65. In the second position (FIGS. 8-10), the plate-like guide-following slide member 85 is in the home position and plate-like guide-following slide member 86 is extended (downstream). As a result, the beam 33 is bent in direction "C" as it passes between rollers 64, 65.

Testing has shown that the present sweep station 32 can deform the continuous beam 33 to a sweep of 1000 mm radius in either selected direction when forming material having a tensile strength of 190 KSI and a cross sectional tubular beam of about 70 mm×70 mm. Further, sweep station 32 is variably controlled by the controller 77 such that the curvature of the sweep can be made constant for a particular section of the beam 33, or can be made to be constantly changing along a particular section of the beam 33, or can be made into a combination of linear and sweeps. Further, the sweeps can be made such that the beam 34 cut from the continuous beam 33 can be symmetrical and can include aligned end sections (see FIG. 11, end sections 35 and 40) and offset center section.

As discussed previously, an exemplary vehicle frame 110 (FIG. 12) can be made from beams made according to the present inventive principals, and by the present apparatus and method. The frame 110 includes various structural beams/components having features now possible using the sweep apparatus 30 of the present invention. It is noted that opposing sides of the vehicle frame 110 will normally be mirror images of each other (or very similar to mirror images) in an actual vehicle frame. However, the opposing sides are illustrated as being different to illustrate that various possibilities can be accommodated.

In particular, the right half of the vehicle frame 110 shown in FIG. 12 includes a single elongated tubular side frame member 111 bent with a compound bidirectional bend (all bends being in a vertical plane) at location 112, location 112 being at a rear wheel of the vehicle when in a vehicle-assembled position to provide room for the rear axle of the vehicle. The side frame member 111 further includes a compound bend (all bends being in a horizontal plane) at location 113 (but the bends being in an orthogonal direction relative to the first bends). The illustrated second bend at location 113 is slightly shallower than the first bend at location 112. It is contemplated that the second bend can be made in a secondary stamping or in a separate bending/reforming operation (see FIG. 13) where the tubular beam 34 is supported while it is forced into the desired three-dimensional shape. A frame tip/bracket 115 (sometimes called a "crush tower") is welded to a front of the side frame member 111, such as for mounting a bumper reinforcement beam 119 with mounting brackets 119' welded/fixed thereto. The illustrated bracket 115 is rectangular in cross section. (However, it is contemplated that the bracket can have a round cross section or another shape. As suggested earlier herein, normally a vehicle frame is symmetrically shaped, the difference here being for purposes of illustration to show alternatives, as will be understood by skilled artisans in this field.) The illustrated bracket 115 and frame components are tubular, and can include crush initiation apertures for providing consistent and predictable energy absorption during a vehicle crash/impact.

The left half of the vehicle frame 110 (FIG. 12) includes a pair of elongated tubular side frame members 121 and 122 with an overlapped connection 123. The overlapped connection 123 can be by direct overlap of ends of components 121 and 122, or can be made by providing an intermediate tube section shaped to telescopingly extend into the ends of components 121 and 122. The components 121 and 122 are welded together, connecting them in a generally aligned fashion to form a side frame member not unlike the member 111. An advantage of using frame members 121 and 122 is that they can be formed in a final shape as formed on the roll-forming apparatus 30 with sweep station 32. Brackets 115' can be welded or bolted to (rear) ends of the frame for attachment of a rear bumper reinforcement beam 34.

The vehicle frame 110 also includes cross members 125, 126 and 127 that extend between the side frame members 111 and rigidly interconnect same. The cross members 125 and 126 are tubular beams (or can be open channels), and include one or more bi-directional bends to meet their dimensional requirements. End flanges are formed on the cross members to matably engage the respective side frame members and to facilitate welding attachment. Also, if desired, crush initiators and/or energy management devices can be incorporated into the cross members 125 and/or 126 and/or 127.

Figure 13:
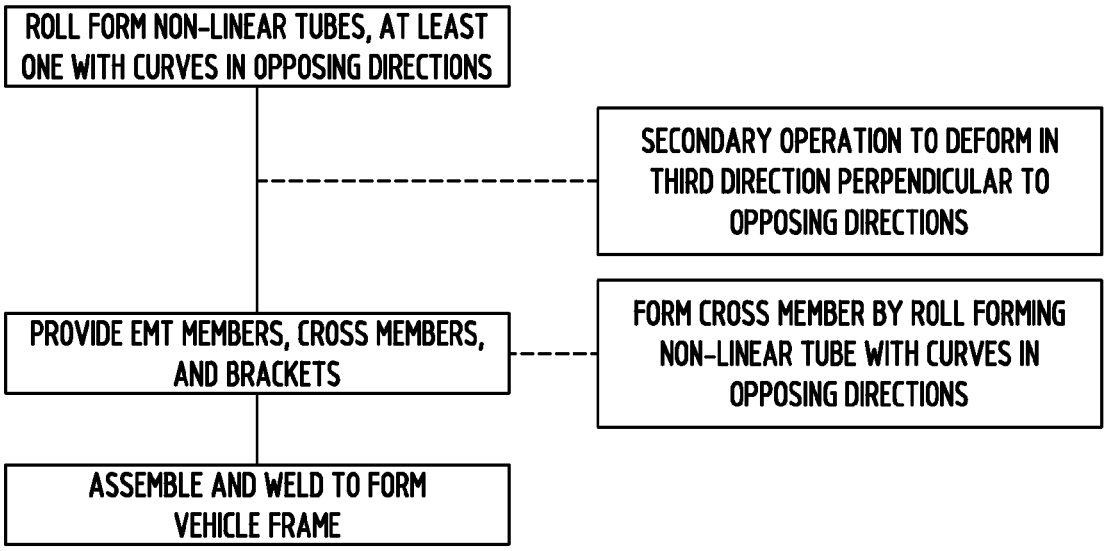
FIG. 13 is a schematic flow diagram showing a method/process of making a vehicle frame.
Figure 14:
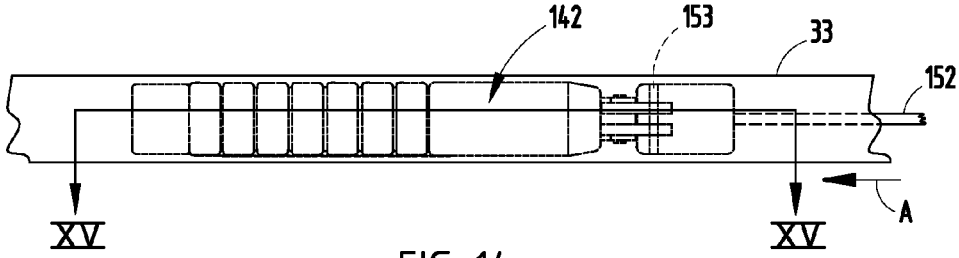
FIGS. 14-18 are side, top cross section, perspective, exploded perspective, and broken perspective views of an internal mandrel.
Figure 15:
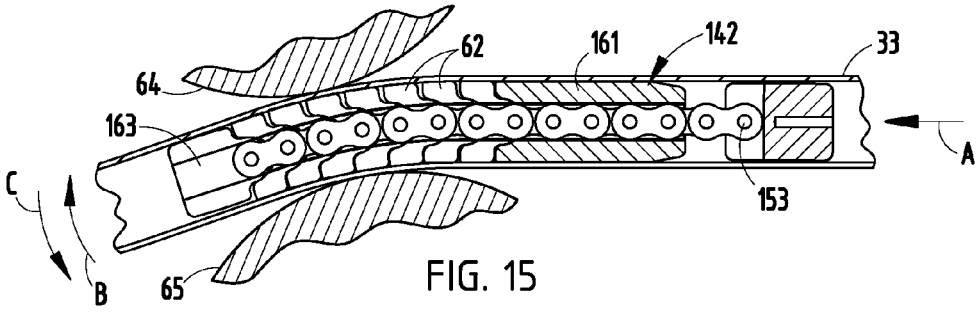
Figure 16:
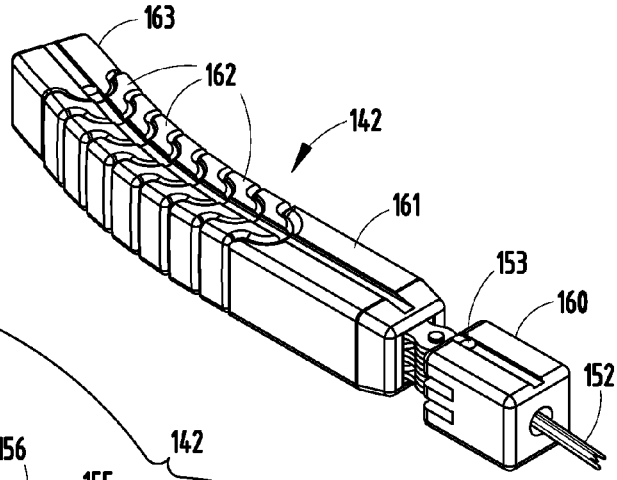
Figure 17:
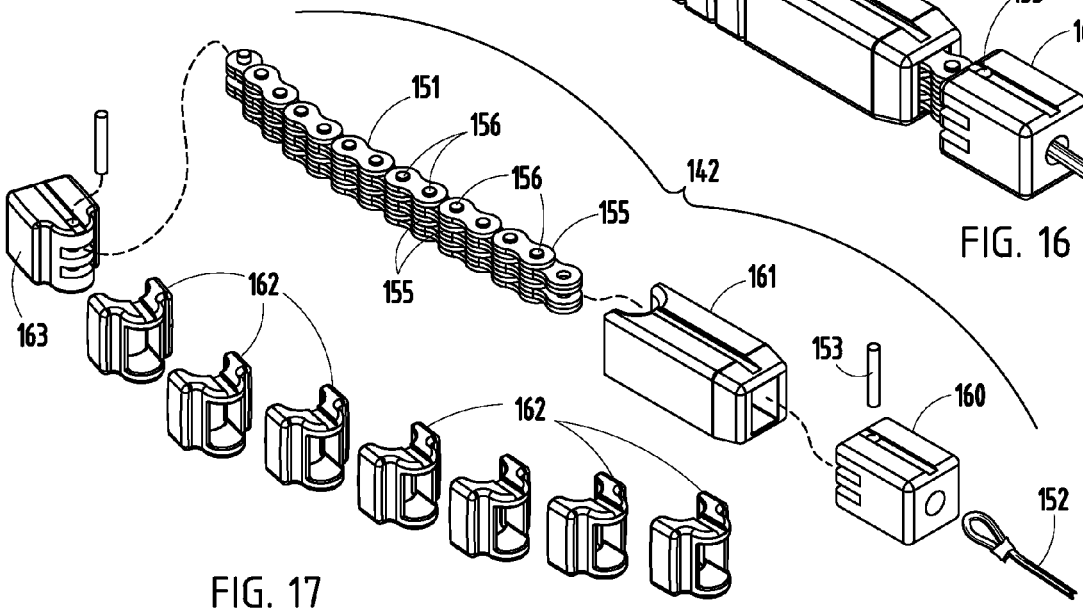
Figure 18:
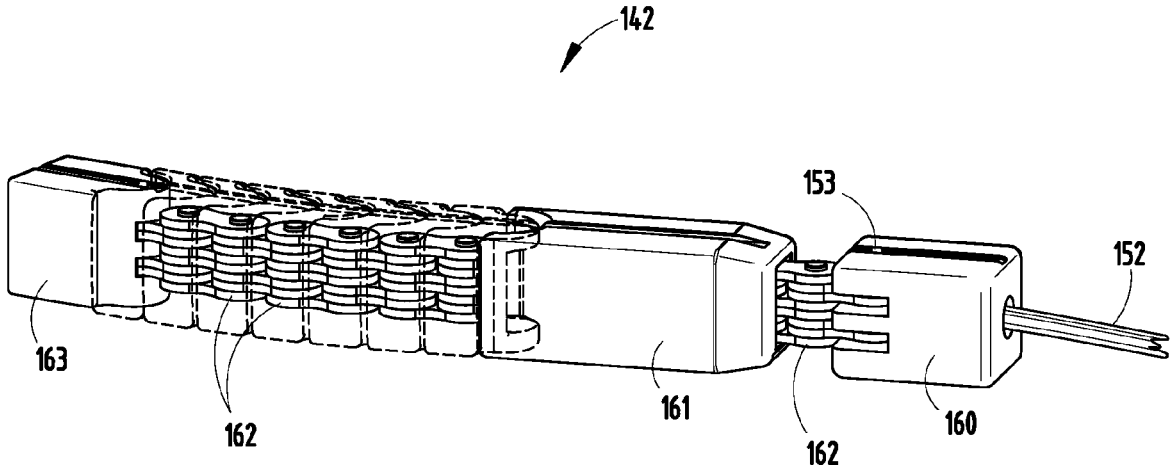

FIG. 13 is a flow diagram showing manufacture of components and of welding an assembly together to form a vehicle frame.

In some circumstances, it may be desirable to provide increasingly sharply curved sweeps that "challenge" the ability of the above sweep station 32. In such event, auxiliary equipment can be added to the sweep station further enhance its ability to provide a dimensionally accurate and consistent sharply curved sweep. Three basic types of such auxiliary equipment are contemplated, including (1) additional downstream external support attached to a downstream side of the sweep station 32 (e.g., a trailing roller or rollers) that engage the continuous beam 33 (called an "external stabilizer"), (2) an upstream external support (called an upstream bend stabilizer or "bridge support") engaging the beam 33 immediately ahead of the rollers 64, 65, and/or an (3) an internal stabilizer 142 (illustrated as an "internal mandrel chain" connected together in a snake-like manner) (see FIGS. 14-18). These concepts may be useful on a sweep apparatus for producing a bi-directionally swept beam, or for producing a single-directionally swept beam, but are not believed to be necessarily required unless the beam 33 is large (e.g., greater than 2"×2") or uses high strength materials (e.g., greater than 80 KSI) or uses thin-walled materials (e.g., less than 2.2 mm thick).

The upstream support (called an upstream bend stabilizer or "bridge support") (FIG. 4) is positioned immediately adjacent the bending rollers for supporting the beam 33 in its linear shape as it enters the rollers 64, 65 at the sweep station 32. The upstream support is supported at side location 141 and has a side shaped to matably slidably engage the beam 33 to support the beam 33 as it travels along its roll-formed centerline into the pinch point between rollers 64 and 65 of the sweep station. By making the upstream support a solid component (rather than a wheel, for example), a front end of the upstream support can be made wedge-shaped, so that the support it provides is closer to the pinch point between rollers 64 and 65 as the beam 33 is bent around a roller (e.g., roller 64 or roller 65).

By supporting the beam 33 immediately adjacent an upstream side of the sweep station 32, a dimensional accuracy of the beam 33 can be greatly increased. The reason is because the beam's walls are stabilized and supported to prevent undesired bending and deformation from "counteractive bending forces." Counteractive bending forces (as used herein) are reactive forces that cause upstream deformation on the beam 33 in a direction away from the bend direction. These reactive forces are caused by the beam 33 acting like a teeter-totter as it is forced to deform around a bending roller (e.g., roller 64). Specifically, the beam's strength and resultant stresses on the beam 33 cause an upstream portion of the beam 33 (for example, 1 to 5 inches ahead of where the beam 33 touches the bending roller 65) to bend in a direction away from the bending roller (64).

It is contemplated that the upstream external support can be located on a single side of the beam 33, but it is contemplated that upstream external supports will likely be positioned on both sides of the beam 33 so that the beam walls are supported regardless of which direction the beam 33 is being swept. (i.e., The upstream external support would stabilize the walls of the beam 33 regardless of whether the beam 33 is being deformed around roller 64 in a first direction of sweep, or is being deformed around roller 65 in a second (opposite) direction of sweep.)

The internal stabilizer 142 (FIGS. 14-19) (also called an "multi-link internal mandrel" or "mandrel snake") includes a plurality of internal mandrel segments connected together by a multi-link chain 151, which is in turn connected to the upstream anchor 55 by a rod 152, such as a solid rod of about 1" diameter. The segments 160-163 have an outer shape configured to fill an internal cavity of the continuous beam 33 and to slide along the beam 33 as the beam 33 moves through the sweep station. The segments 160-163 have an outside cross-sectional dimension sized to that the walls of the beam 33 do not collapse into the cavity and so that a cross sectional shape of the beam 33 is maintained during the sweep-forming process.

The illustrated upstream-most first segment 160 is elongated (such as 3-4 inches) and includes apertures for receiving a pin 153 that connects the chain 151 (and block 160) to a loop on the anchor rod 152. The first segment 160 is held in a stationary position located upstream of the pinch point between the rollers 64 and 65. The second segment 161 is also elongated (such as about 4-6 inches) which assists in it staying aligned with the line direction of the roll forming process. The second segment 161 is also held in a stationary position located upstream of the pinch point between the rollers 64 and 65. The segment 161 is followed by several shorter segments 162 (each about an inch or two long) and an elongated last trailing segment 163 (elongated to about 2-3 inches). The segments 162 form a stacked line of blocks/mandrels extending past the pinch point between the rollers 64 and 65, and the segment 163 is located downstream of the rollers 64 and 65. A length of the segments 160, 161 and 163 helps keep their alignment with the continuous beam 33 being formed. The movement of segments 162 and 163 follow a shape caused by the rollers 64 and 65 as the rollers 64 and 65 are moved to different positions (see FIGS. 2-10), thus adding stability to the continuous beam 33 as it moves across the sweep station.

Each segment 161-162 has a through-hole, and segments 160 and 163 have a structure for connection to opposite ends of the links of the chain 151. The chain 151 extends through the segments 161-162 and connects the segments 160-163. Each segment 160-163 is structurally made and interconnected in a way to allow rotation in either direction from side to side. Specifically, each segment 161-163 has a joint formed by a narrowed upstream-facing cylindrically-shaped nose and a mating downstream-facing cylindrical recess, so that they abut to form a rotational bearing surface that allows rotation of the snake-like internal mandrel in either direction. It is contemplated that different chains can be used to secure the internal mandrel components together. The illustrated chain 151 includes flat links 155 and transverse pins 156 that interconnect in a manner similar to a bicycle chain or motorcycle drive chain for engaging a sprocket. The illustrated links 155 are flat and each have a figure "8" shape (see FIGS. 15 and 17) and can be two or three deep, with ends of the links 155 offset longitudinally and pivoted together by pins so that a continuous high strength chain is formed that can be flexed in either direction in a horizontal plane . . . but not flexed in a direction out of the plane.

Figure 19:
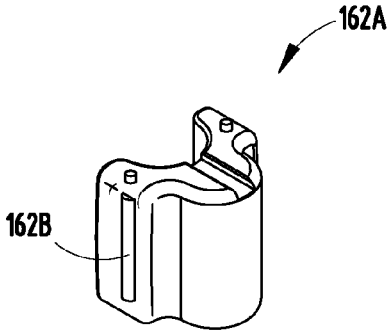
FIG. 19 is a modified segment from that shown in FIG. 17.
Figure 20:
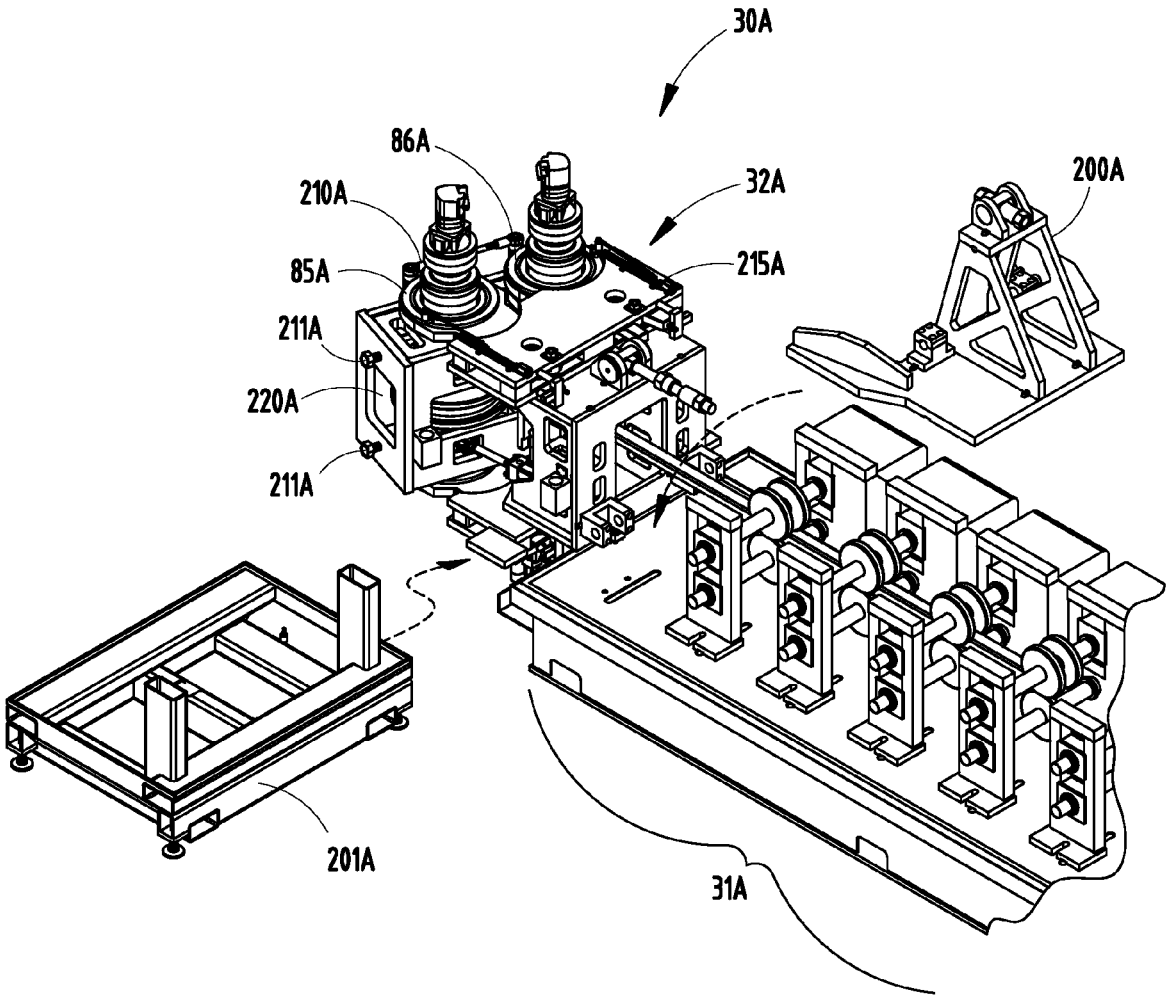
FIGS. 20-28 are similar to FIGS. 2-10, but showing another version of the bi-directional sweep station.
Figure 21:
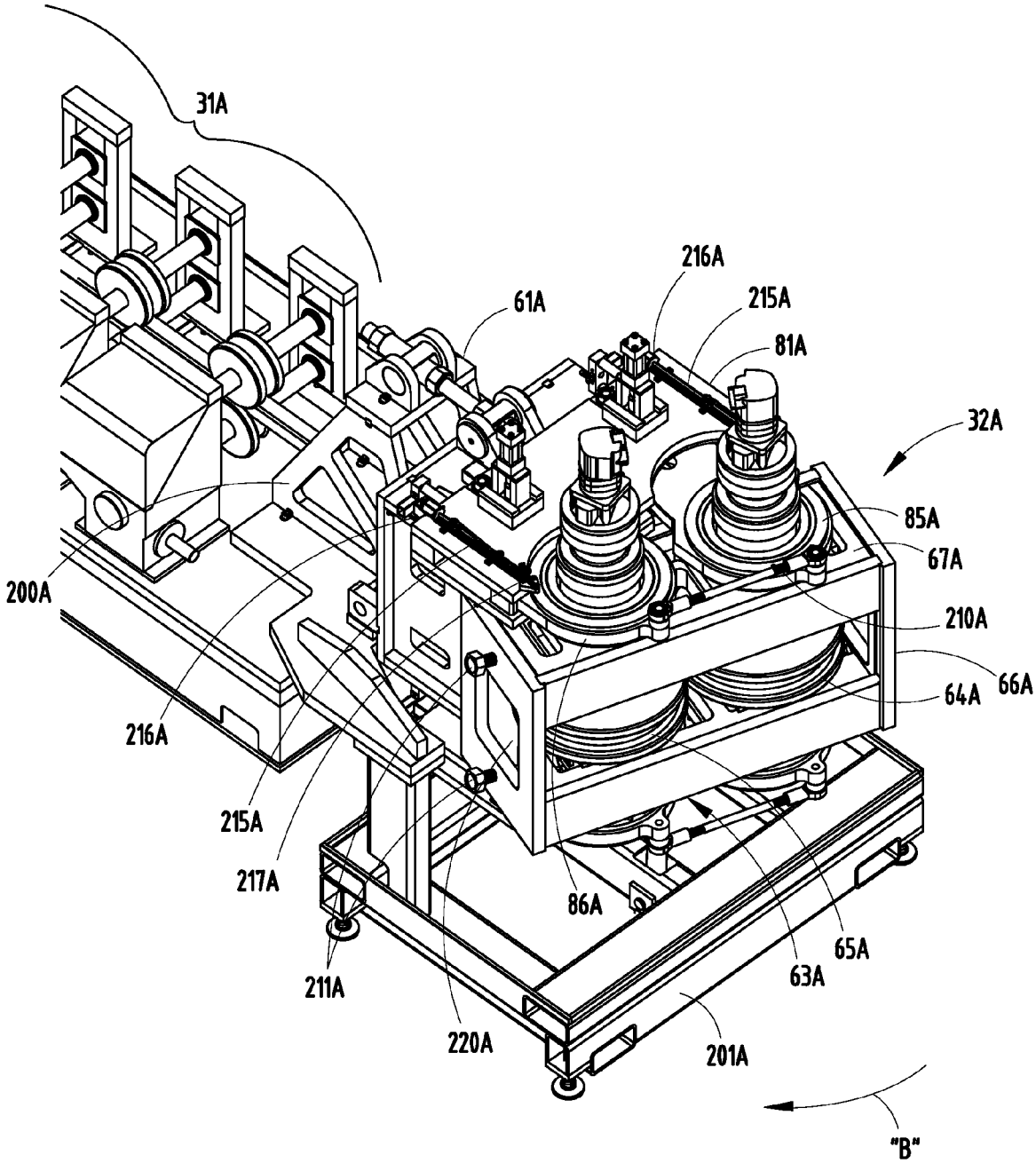
Figure 22:
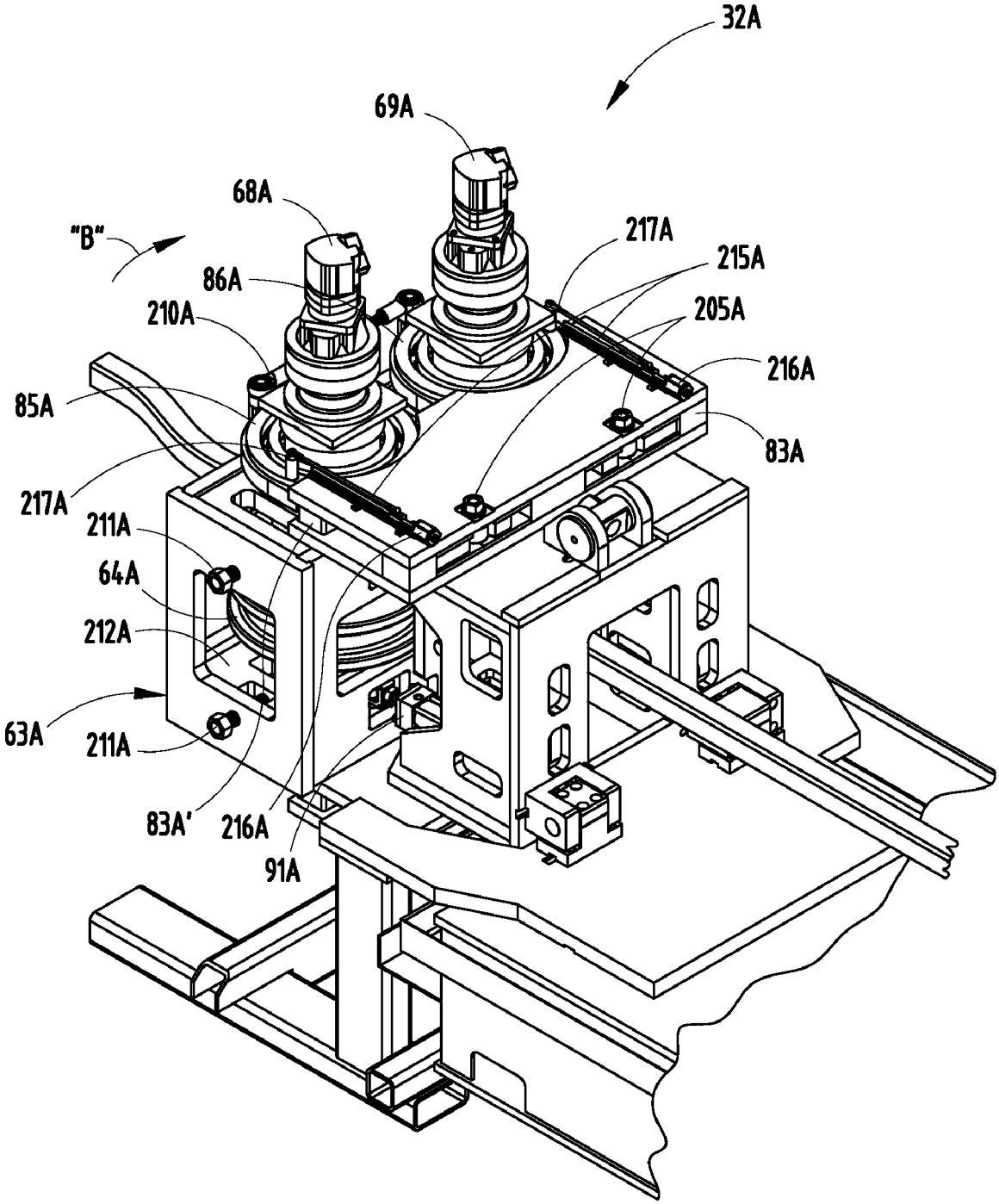
Figure 23:
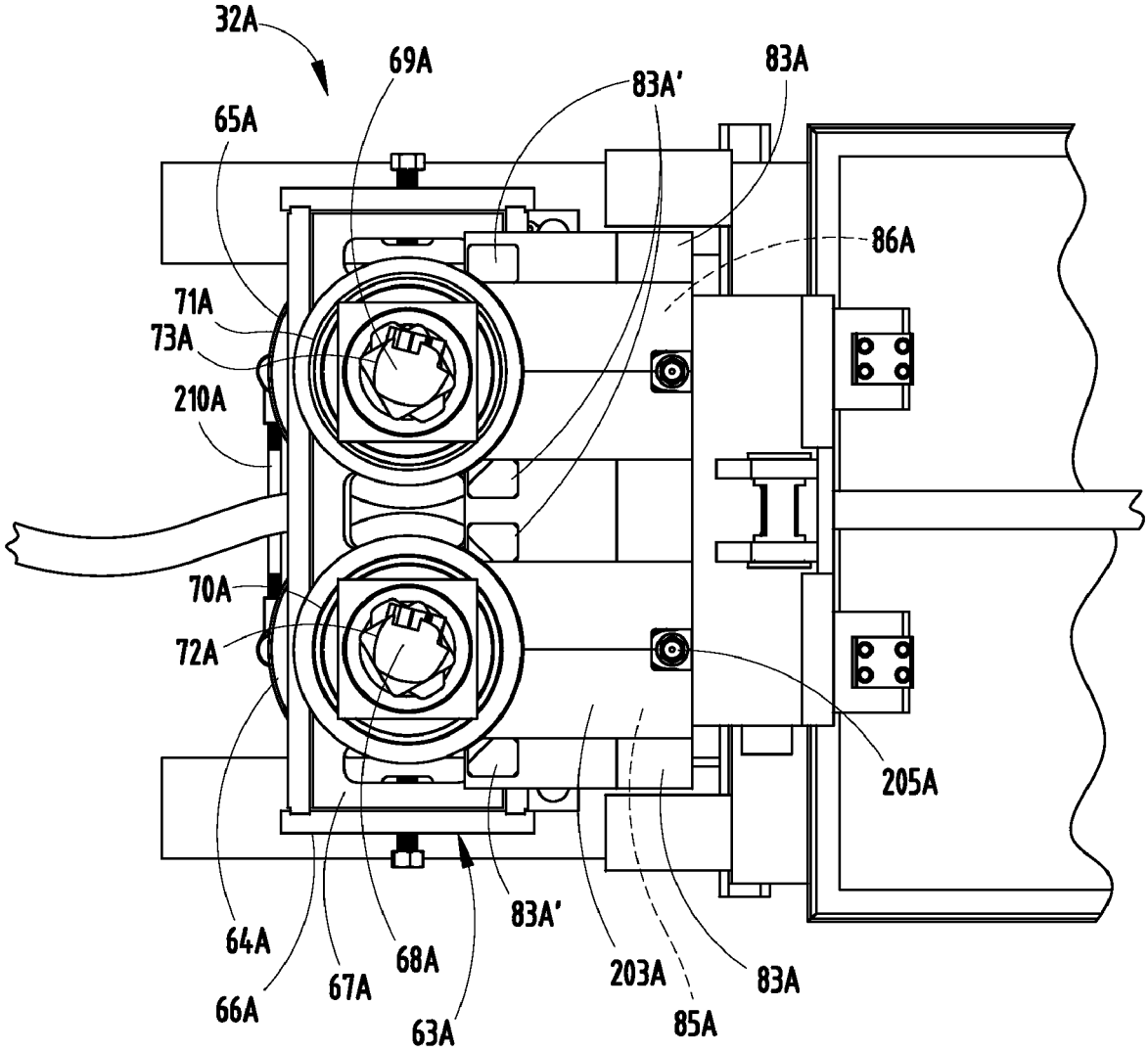
Figure 24:
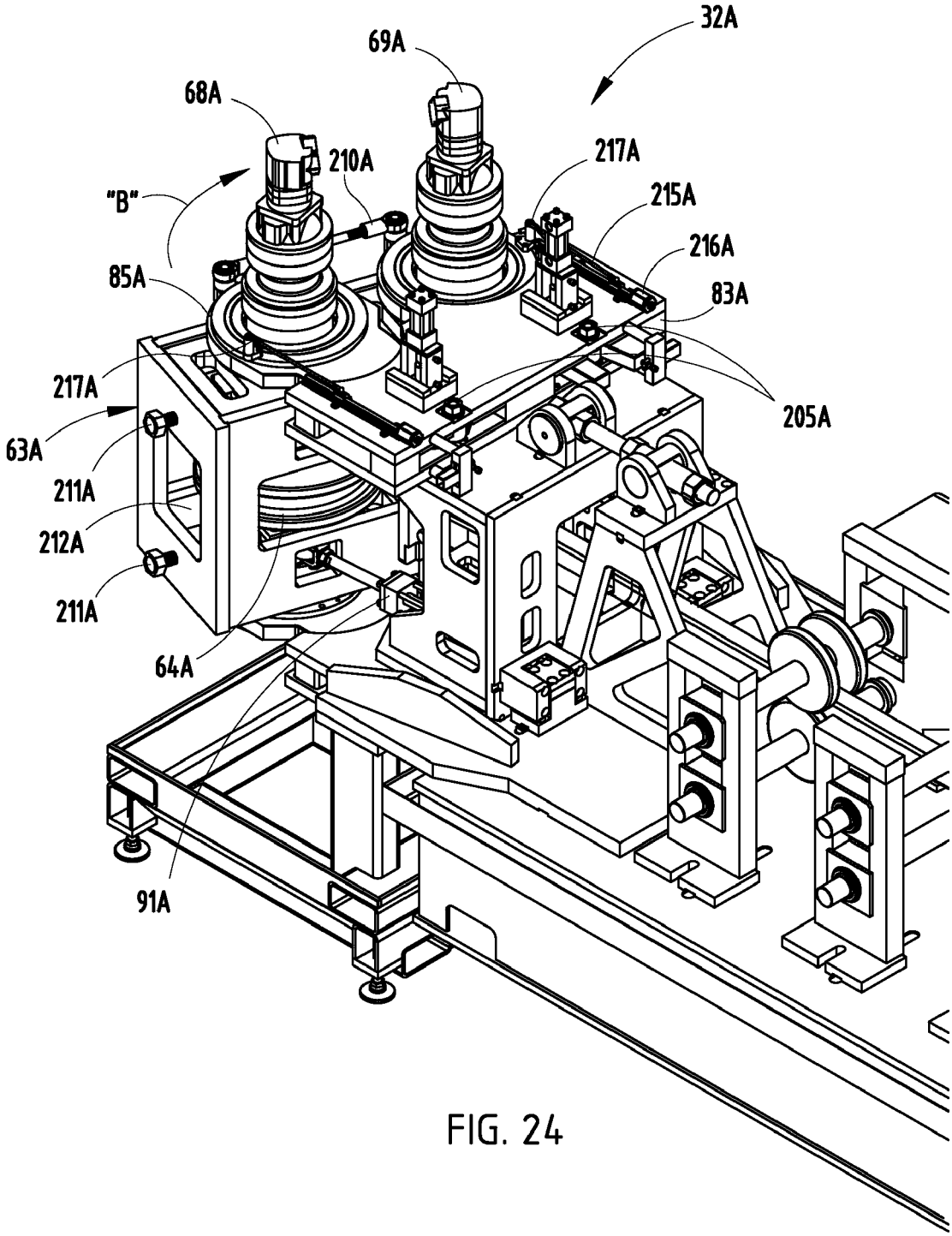
Figure 25:
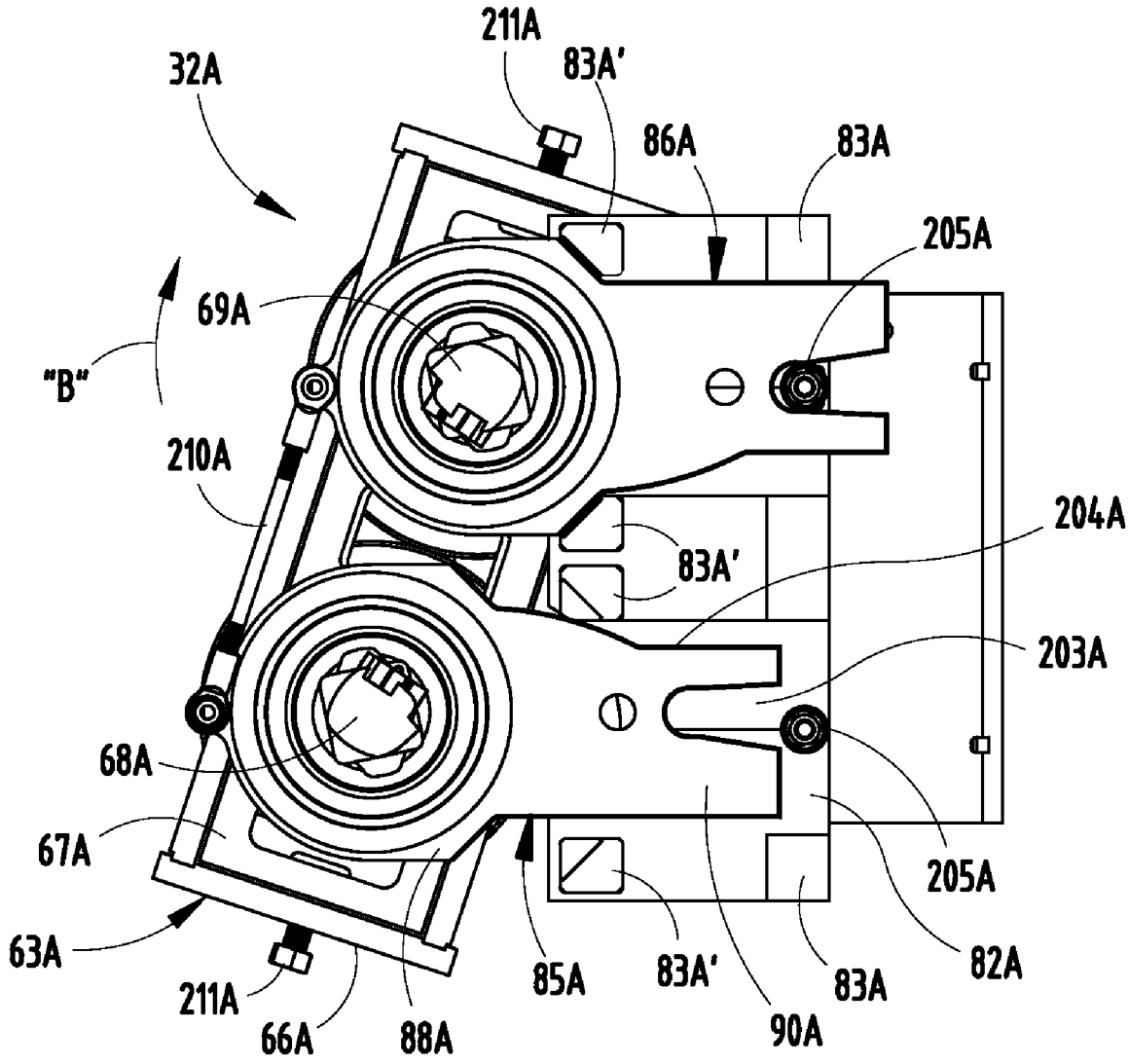
Figure 26:
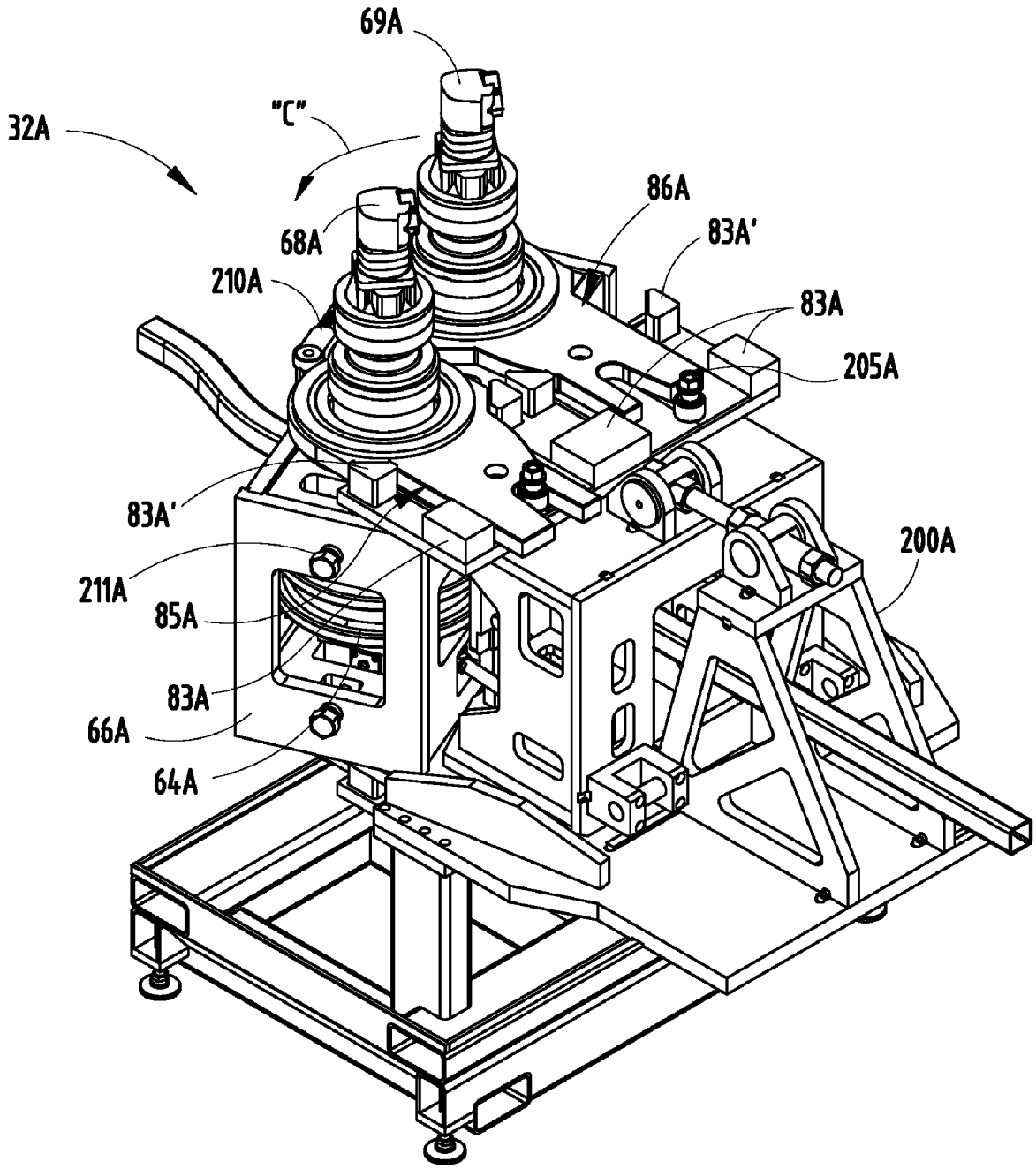
Figure 27:
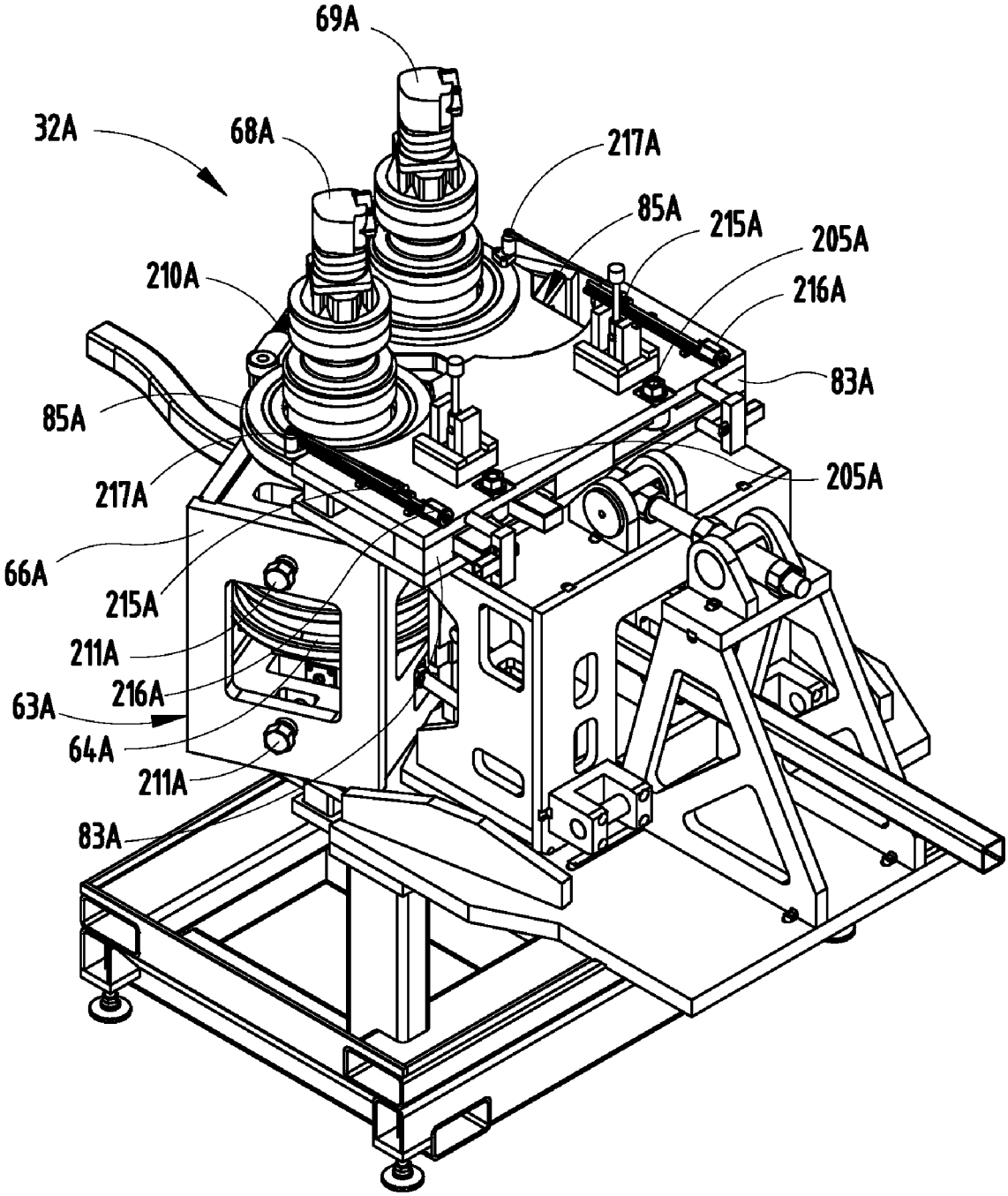
Figure 28:
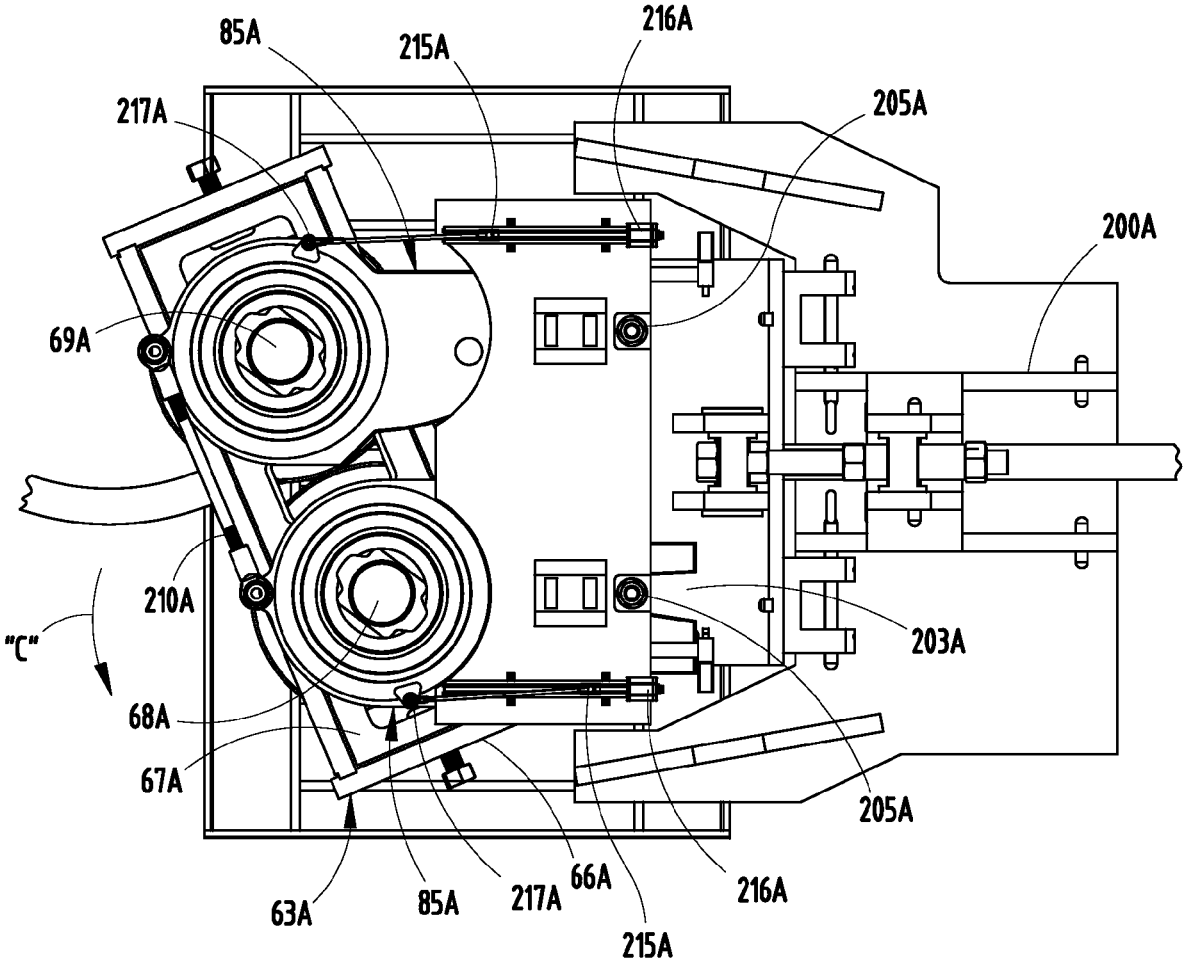

FIG. 19 illustrates a modified segment 162A where at least one of the outwardly-facing sides of the segment 162A includes a roller pin 162B. This allows reduced frictional engagement of the sides of the segments 162A since the roller pin 162B rolls along the inside surface of the continuous beam 33 (instead of sliding contact). This arrangement is longer lasting than with segments 162, but of course segments 162A are more expensive, and are potentially not practical (or less practical) unless a size of the segment 162A is sufficiently large and concurrently, the pressures of forming the beam 33 are sufficiently large to justify using segment 162A.

A modified roll forming apparatus 30A (FIGS. 20-28) is also shown. Components that are similar and/or identical to apparatus 30 are identified using the same numbers, but with a letter "A" or "B". This is done to reduce redundant discussion. The FIGS. 20-28 are generally similar to the FIGS. 2-10, respectively, but with modifications as discussed below.

The apparatus 30A (FIG. 20) includes a roll former 31A and sweep station 32A. The sweep station 32A is anchored by braced subframe 200A and is operably supported on a stand 201A. Notably, the subframe 200A and stand 201A can be sized to support an appropriate weight and size of the sweep station 32A as needed for particular versions of same.

In sweep station 32A, the plate-like extendable slide members 85A and 86A (FIG. 20, but see FIG. 25) are modified for improved sweeping action and reset. Notably, the slide members 85A and 86A are mirror images of each other, such that only one need be described. The slide member 85A (FIG. 25) includes a narrowed tail section 90A including a tail slot 203A and formed inner surface 204A. The tail slot 203A is shaped to engage a roller bearing 205A on a post secured into the plate 82A. The sides of the slot 203A are slightly angled, so that the entrance into the slot 203A forms a wide opening facing the roller bearing 205A. This allows the slot 203A to capture the roller bearing 205A while still allowing some non-linear movement of slide member 85A during extension. A bottom of the slot 203A is sized to closely engage the roller bearing 205A, such that the slide member 85A is accurately positioned when in its upstream home position.

A front of the slide members 85A and 86A are secured together by a tie rod 210A. The tie rod 210A is adjustable in length so that as the rollers 64A, 65A are adjusted toward each other to engage the beam 33A, the tie rod 210A can also be adjusted. When the slide member 85A is moved downstream, the tie rod 210A causes the large end 88A of the slide member 85A to rotate along a downstream arcuate path around axis 69A during extension. The formed inner surface 204A is shaped to accommodate this movement of the slide member 85A . . . allowing the inner surface 204A to avoid interference from the spacer 83A' and/or 83A.

Figure 29:
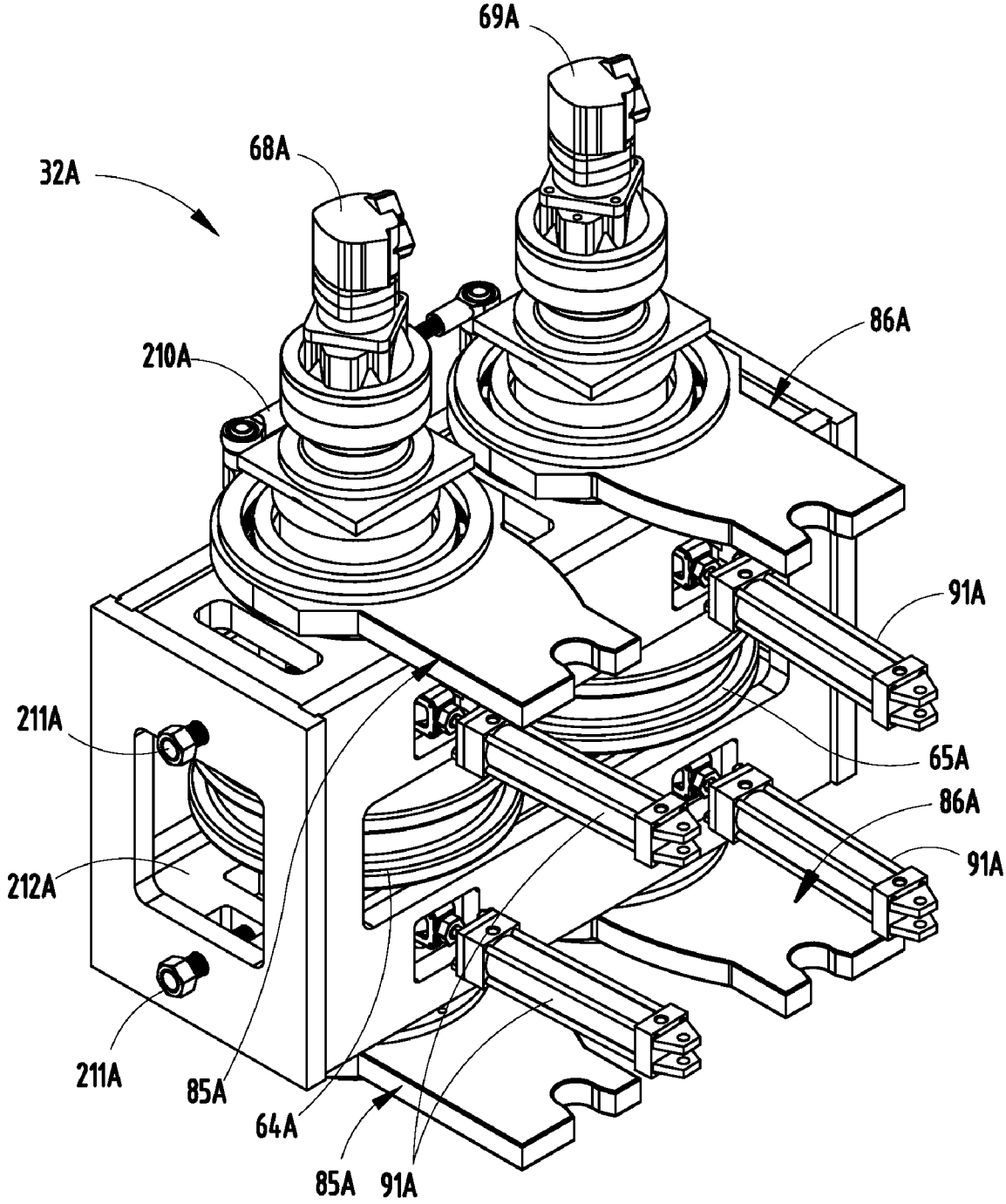
FIGS. 29-30 are perspective views of the sweep subframe and assembly with FIG. 30 having some components removed to better show other components inside.
Figure 30:
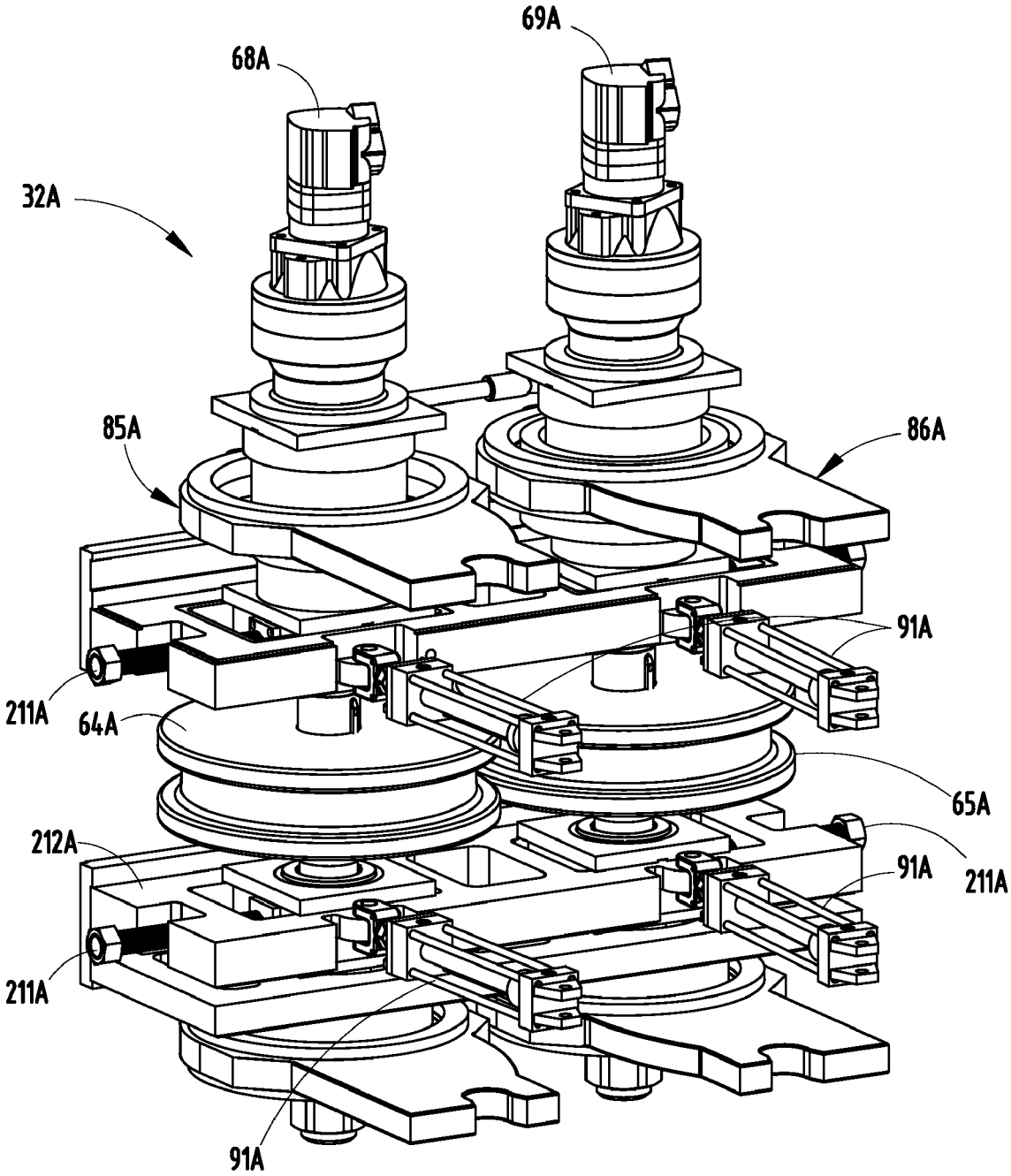

An adjustment mechanism (FIGS. 29-30) is provided in the sweep station 32A to allow the rollers 64A and 65A to be adjusted toward (and away from) each other. Adjuster bolts 211A and an adjustable bearing support 212A for supporting the rollers 64A and 65A are provided. They are operably supported on the subframe 63A for the for adjusting a position of the bending rollers toward each other (to be tight against the continuous beam 33A). As noted above, the tie rod 210A is also adjustable to accommodate a similar adjustment in its length.

It is noted that the "sweep limiter" chain (94) is eliminated in the present sweep station. Instead, a potentiometer or sensor system is attached between a stationary part of the sweep station 32A and the subframe 63A. The potentiometers 215A are connected to the controller 77 for controlling the actuators 91A . . . which in turn control a position of the sub-frame 32A and bending rollers 64A, 65A so that the beam 33A is given a particular desired sweep radii (i.e., longitudinal curvature). The potentiometers 215A also operate to sense when (if) the sweep station is "over-extended" in a downstream direction. Specifically, a potentiometer 215A (FIG. 21) is attached on each side of the sweep station 32A, with one end 216A being attached to the plate 81A and its other downstream end 217A attached to the subframe 63A. These potentiometers 215A are connected electrically to the controller 77 so that, if a problem occurs, the apparatus is immediately stopped.

Various modifications are made to various components for handling the high stresses generated in the present sweep station. Also, modifications are made to increase efficiency of operation. For example, the apertures 220A in the side end plates 66A and other plates of the subframe 63A allows an operator to see into the sweep station, allowing better control since one can see what is happening within the sweep station. Also, the anchoring stanchion 200A is designed for optional handling of stress and for handling a great amount of stress without failure or unacceptable deformation.

It is to be understood that variations and modifications can be made on the aforementioned structure without departing from the concepts of the present invention, and further it is to be understood that such concepts are intended to be covered by the following claims unless these claims by their language expressly state otherwise.

The embodiments of the invention in which an exclusive property or privilege is: claimed are defined as follows:

1. A roll form apparatus comprising:

a roll former including rolls for forming a sheet of steel material into a structural beam defining a longitudinal line; and a sweep station in-line with the roll former and including a sweep-forming device for selectively sweeping the structural beam, the sweep-forming device including a first slide member formed by at least one first elongated plate elongated in an upstream direction generally parallel to the longitudinal line and movable between an upstream home position and at least one first downstream position for deforming the structural beam in a first direction away from the longitudinal line and including a second slide member formed by at least one second elongated plate elongated in the upstream direction generally parallel to the longitudinal line and movable between the upstream home position and at least one second downstream position for deforming the structural beam in a second direction opposite the first direction away from the longitudinal line while continuously operating the roll former, each of the first and second slide members being independently movable and being configured to bend the structural beam only when the other of the first and second slide members are in the home position.

2. The apparatus defined in claim 1, wherein the rolls form the sheet into a tubular shape and the roll former includes a welder to permanently fix the beam in the tubular shape.

3. The apparatus defined in claim 1, wherein the sweep station includes opposing sweep rollers and an adjustable support structure for adjustably supporting each of the opposing sweep rollers for translational movement.

4. The apparatus defined in claim 3, wherein the sweep station includes a subframe for supporting the opposing sweep rollers, the subframe being operably supported by the first and second slide members and the adjustable support structure, and including at least one actuator for rotatably moving the subframe in either of the first and second directions.

5. The apparatus defined in claim 4, wherein the support structure is constructed to selectively move at least one of the opposing rollers partially around the other opposing roller in a downstream direction.

6. The apparatus defined in claim 4, wherein the support structure supports the subframe for movement in either first or second arcuate paths that extend in a downstream direction.

7. The apparatus defined in claim 6, wherein the support structure includes separate actuators connected to each of the slide members for moving the opposing sweep rollers between an upstream home position where the beam is not swept and to different downstream positions where the beam is swept in first the first direction and then the second direction.

8. The apparatus defined in claim 6, wherein the opposing rollers include first and second axles supported on the subframe, and the first and second slide members operably selectively supporting the subframe for rotation about the first and second axles.

9. The apparatus defined in claim 8, wherein the sweep station includes a frame with a pair of top guides and a pair of bottom guides each defining a cavity therebetween, the first and second slide members each including a portion extending into one of the cavities for controlled motion between the associated pairs of guides.

10. The apparatus defined in claim 1, wherein the sweep station includes a main frame, a subframe movably supported by the main frame, and wherein the slide members slidably engage the main frame to movably support the subframe in a selected one of two different arcuate paths.

11. The apparatus defined in claim 10, including stops engaging the slide members to accurately define the upstream home position where the structural beam remains linear and is not given a longitudinally curved shape.

12. The apparatus defined in claim 3, including an upstream support positioned immediately upstream and adjacent the sweep rollers.

13. The apparatus defined in claim 1, including at least one internal mandrel positioned in part between opposing rollers in the sweep station.

14. The apparatus defined in claim 13, wherein the at least one internal mandrel includes a plurality of internal segments interconnected to form a stacked chain bendable within a given plane but in opposite directions in said plane.

15. A sweep station for sweeping sections of a beam away from a longitudinal line defined by the beam, comprising:

a main frame; and a sweep-forming device including stops and a subframe operably supported on the main frame by first and second slide members for movement from a home position where the first and second slide members both abut the stops to hold the subframe generally perpendicular to the longitudinal line with the beam not being deformed, and for movement to a first angled position where only the second slide member abuts the stops to sweep a first section of the beam in a first direction away from the longitudinal line, and for movement to a second angled position where only the first slide member abuts the stops to sweep a second section of the beam in a second direction away from the longitudinal line, the second direction being on a side opposite the first direction.

16. The apparatus defined in claim 15 including at least one internal mandrel positioned in part between opposing rollers in the sweep-forming device.

17. The apparatus defined in claim 16, wherein the at least one internal mandrel includes a plurality of internal segments interconnected to form a stacked chain bendable within a given plane but in opposite directions in said plane.

18. A method of roll-forming comprising steps of:

roll-forming a sheet of material into a continuous beam defining a longitudinal line;

providing a sweep-forming device including a subframe, slide members operably supporting ends of the subframe for angular movement, beam-deforming members carried by the slide members, and stops on each side engaging the slide members to hold first and second ends of the subframe in a home position where the continuous beam is not being deformed; and during the step of roll-forming, sweeping a first section of the continuous beam in a first direction away from the longitudinal line by angularly moving the subframe while maintaining engagement of at least one of the slide members against the stops to hold the first end while also moving the second end away from the stops, and later sweeping a second section of the continuous beam away from the longitudinal line in a second direction different than the first direction by angularly moving the subframe while maintaining engagement of at least one of the slide members against the stops to hold the second end while also moving the first end away from the stops.

19. The method defined in claim 18, wherein the second direction is opposite the first direction.

20. The method defined in claim 19, including providing an actuator adapted to pivot the subframe in either of opposing directions from the longitudinal line and including controlling the actuator to position the subframe at desired angled locations and orientations relative to the continuous beam.

21. The method defined in claim 20, including reforming the beam in a third direction different than the first and second directions.

22. A sweep station for use in-line with a roll former, comprising:

a sweep-forming device for selectively sweeping a roll formed structural beam, the sweep-forming device including a first slide member formed by at least one first elongated plate elongated in an upstream direction generally parallel to the longitudinal line and movable between a home position and at least one first angled position for deforming the structural beam in a first direction away from the longitudinal line and including a second slide member formed by at least one second elongated plate elongated in the upstream direction generally parallel to the longitudinal line and movable between the home position and at least one second angled position for deforming the structural beam in a second direction opposite the first direction away from the longitudinal line while continuously operating the roll former, each of the first and second slide members having a narrow end and a large end and defining a stop-engaging surface therebetween, and the sweep station including stops that abut the stop-engaging surface when in the home position.

* * * * *